US012279731B2

(12) United States Patent
Ryu et al.

(10) Patent No.: US 12,279,731 B2
(45) **Date of Patent: *Apr. 22, 2025**

(54) NOZZLE FOR CLEANER

(71) Applicant: LG Electronics Inc., Seoul (KR)

(72) Inventors: Jungwan Ryu, Seoul (KR); Moohyun Ko, Seoul (KR); Jinhyouk Shin, Seoul (KR); Ingyu Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 146 days.

This patent is subject to a terminal disclaimer.

(21) Appl. No.: 17/851,423

(22) Filed: Jun. 28, 2022

(65) Prior Publication Data

US 2022/0322905 A1 Oct. 13, 2022

Related U.S. Application Data

(63) Continuation of application No. 16/398,582, filed on Apr. 30, 2019, now Pat. No. 11,399,684.

(30) Foreign Application Priority Data

Apr. 30, 2018 (KR) ..... 10-2018-0050108
Jul. 30, 2018 (KR) ..... 10-2018-0088783

(51) Int. Cl.
*A47L 11/206* (2006.01)
*A47L 9/06* (2006.01)
*A47L 11/40* (2006.01)

(52) U.S. Cl.
CPC ..... *A47L 11/206* (2013.01); *A47L 9/068* (2013.01); *A47L 11/4013* (2013.01);
(Continued)

(58) Field of Classification Search
CPC .... A47L 11/206; A47L 9/068; A47L 11/4013; A47L 11/4038; A47L 11/4083;
(Continued)

(56) References Cited

U.S. PATENT DOCUMENTS 6,792,648 B2 9/2004 Lee
6,842,941 B2 1/2005 Lee
(Continued)

FOREIGN PATENT DOCUMENTS

CN 101273861 A 10/2008
CN 101573299 A 11/2009
(Continued)

*Primary Examiner* — David Redding
(74) *Attorney, Agent, or Firm* — Birch, Stewart, Kolasch & Birch, LLP

(57) ABSTRACT

A nozzle for a cleaner has a nozzle main body including an intake channel to suction air. The nozzle includes first and second rotary cleaning units spaced apart from each other in a lateral direction under the nozzle main body. Each of the first and second rotary cleaning units includes a rotary plate coupled to a dust cloth. The nozzle further includes a first driving device to drive the first rotary cleaning unit and a second driving device to drive the second rotary cleaning unit. The nozzle includes a water tank to store water. Further, the nozzle has a water supply channel to supply water in the water tank to the rotary cleaning units. The nozzle has a water pump and a pump motor to drive the water pump to pump the water to the dust cloth.

30 Claims, 36 Drawing Sheets

(52) U.S. Cl.
CPC ..... *A47L 11/4038* (2013.01); *A47L 11/4083* (2013.01); *A47L 11/4094* (2013.01)

(58) Field of Classification Search
CPC .. A47L 11/4094; A47L 9/0472; A47L 7/0009; A47L 11/201; A47L 9/0686; A47L 11/2025; A47L 11/4069; A47L 11/408; A47L 11/4088
See application file for complete search history.

(56) References Cited

U.S. PATENT DOCUMENTS

| | | | | |
|---|---|---|---|---|
| 7,743,462 | B2 | 6/2010 | Yoo | |
| 8,161,595 | B1 | 4/2012 | Wilson | |
| 8,549,697 | B1 * | 10/2013 | Moyher, Jr. ..... | A47L 11/4008 15/319 |
| 9,351,618 | B2 | 5/2016 | Van Der Kooi et al. | |
| 10,602,902 | B2 | 3/2020 | Ding et al. | |
| 10,638,901 | B2 | 5/2020 | Yang et al. | |
| 2001/0027586 | A1 | 10/2001 | Lee | |
| 2003/0221281 | A1 | 12/2003 | Oh | |
| 2004/0163199 | A1 | 8/2004 | Hsu | |
| 2005/0223522 | A1 | 10/2005 | Song et al. | |
| 2007/0074370 | A1 | 4/2007 | Oh | |
| 2007/0157422 | A1 | 7/2007 | Oh et al. | |
| 2008/0282490 | A1 | 11/2008 | Oh | |
| 2014/0115819 | A1 | 5/2014 | Liscio | |
| 2019/0223675 | A1 | 7/2019 | Jang et al. | |
| 2019/0223676 | A1 | 7/2019 | Jang et al. | |
| 2019/0223678 | A1 | 7/2019 | Park et al. | |
| 2019/0223681 | A1 | 7/2019 | Jang et al. | |
| 2019/0231161 | A1 | 8/2019 | Jang et al. | |
| 2019/0270124 | A1 | 9/2019 | Jang et al. | |
| 2019/0307305 | A1 | 10/2019 | Jang et al. | |

FOREIGN PATENT DOCUMENTS

| | | | |
|---|---|---|---|
| CN | 104703525 | A | 6/2015 |
| CN | 204683491 | U | 10/2015 |
| CN | 103356132 | B | 3/2016 |
| EP | 2 033 559 | A2 | 3/2009 |
| EP | 1 769 711 | A2 | 4/2017 |
| KR | 97-53478 | U | 10/1997 |
| KR | 20-0148059 | Y1 | 6/1999 |
| KR | 2001-0093648 | A | 10/2001 |
| KR | 10-0400515 | B1 | 10/2003 |
| KR | 10-0405244 | B1 | 11/2003 |
| KR | 10-2008-0020304 | A | 3/2008 |
| KR | 10-0848568 | B1 | 7/2008 |
| KR | 10-1655684 | B1 | 9/2016 |
| KR | 10-2017-0028765 | A | 3/2017 |
| KR | 10-2018-0008248 | A | 1/2018 |
| TW | 123375 | A | 11/1989 |
| TW | 201806538 | A | 3/2018 |
| TW | 201811251 | A | 4/2018 |
| WO | WO 2014/071696 | A1 | 5/2014 |
| WO | WO 2016/089040 | A1 | 6/2016 |
| WO | WO 2018/012914 | A1 | 1/2018 |

* cited by examiner

NOZZLE FOR CLEANER

CROSS-REFERENCE TO RELATED APPLICATIONS

This application is a continuation of U.S. application Ser. No. 16/398,582, filed Apr. 30, 2019, which claims priority under 35 U.S.C. § 119 to Korean Patent Application No. 10-2018-0050108, filed in the Republic of Korea on Apr. 30, 2018, and Korean Patent Application No. 10-2018-0088783, filed in the Republic of Korea on Jul. 30, 2018, the disclosures of all of which are hereby incorporated by reference in their entireties.

BACKGROUND OF THE INVENTION

The present invention relates to a nozzle for a cleaner.

A cleaner is a device that performs cleaning by suctioning or wiping dust or dirt off of a place to be cleaned.

Cleaners may be classified into a manual cleaner that a user moves in person for cleaning and an automatic cleaner that automatically moves for cleaning.

Further, manual cleaners can fall into, depending on the types of cleaners, a canister cleaner, an upright cleaner, a handy cleaner, a stick cleaner, etc.

These cleaners can clean a floor using a nozzle. In general, a nozzle can be used to suction air and dust. Depending on the types of nozzles, a dust cloth is attached to a nozzle, and a floor can be cleaned by the dust cloth.

A suction port assembly of vacuum cleaner has been disclosed in Korean Patent No. 10-0405244.

The suction port assembly of prior art document 1 includes a suction port main body having a suction port.

The suction port main body includes a first suction channel at the front, a second suction channel at the rear, and a guide passage formed between the first suction channel and the second suction channel.

A dust cloth is rotatably installed at the lower end of the suction port main body and a rotating unit for driving the dust cloth is disposed in the suction port main body.

The rotating unit includes one rotary motor and gears for transmitting power from the rotary motor to a plurality of rotors, to which the dust cloth is attached.

However, according to prior art document 1, since a pair of rotors disposed at the left and right sides is rotated by one rotary motor, when the rotary motor breaks down or malfunctions, all of the pair of rotors cannot be rotated.

Further, in order to rotate a pair of rotors using one rotary motor, the rotary motor is disposed at the center of the suction port main body. Therefore, a suction channel for avoiding interference with the rotary motor has to be designed. Accordingly, there is a defect that the suction channel is made long and the structure for forming the suction channel is complicated.

Further, since a structure for supplying water to the dust cloth is not provided in prior art document 1, a user has to supply water to a dust cloth in person in order to perform cleaning using a wet dust cloth.

On the other hand, a cleaner has been disclosed in Korean Patent Application Publication No. 10-2017-0028765, which is prior art document 2.

The cleaner disclosed in prior art document 2 includes a cleaner body having a dust cloth rotatably disposed at the lower portion, a water tank mounted on a handle connected to the cleaner body or on the cleaner body, a water spray nozzle installed to spray water ahead of the cleaner body, and a water supplier supplying water in the water tank to the water spray nozzle.

According to prior art document 2, since the water spray nozzle sprays water ahead of the cleaner body, the sprayed water may not get the dust cloth wet, but instead, get other structures wet.

Further, since the water spray nozzle is disposed at the center of the cleaner body, while the dust cloth is arranged in the left-right direction, there is a problem that the dust cloth cannot sufficiently absorb the water sprayed ahead of the cleaner body.

Further, since there is no channel for suctioning air in prior art document 2, a floor can only be wiped, so a user has to manually remove dirt on the floor.

SUMMARY OF THE INVENTION

The present invention provides a nozzle for a cleaner that can not only absorb dirt on a floor, but wipe the floor by rotating a dust cloth and supplying water to the dust cloth.

Further, the present invention provides a nozzle for a cleaner in which water in a water tank can be stably supplied to a rotary cleaning unit during cleaning.

Further, the present invention provides a nozzle for a cleaner that can reduce a loss of channel by preventing an air channel for airflow from increasing in length even if a structure that can wipe a floor using a dust cloth is applied.

Further, the present invention provides a nozzle for a cleaner that can minimize an increase in height of a nozzle and can increase the amount of water to be stored in a water tank.

Further, the present invention provides a nozzle for a cleaner that can secure a cleaning area by a dust cloth even from a small amount of movement during cleaning using a nozzle.

Further, the present invention provides a nozzle for a cleaner in which the weight of a plurality of driving units may be uniformly distributed left and right.

Further, the present invention provides a nozzle for a cleaner that may prevent the center of gravity of a nozzle from concentrating on a driving unit with a water tank mounted.

Further, the present invention provides a nozzle for a cleaner that may prevent water discharged through a water supply channel from flowing into a nozzle main body.

Further, the present invention provides a nozzle for a cleaner that may minimize the length of a water supply channel for supplying water in a water tank to a rotary cleaning unit.

Further, the present invention provides a nozzle for a cleaner that may minimize leakage of water that is discharged from a water tank.

Further, the present invention provides a nozzle for a cleaner that can supply the same amount of water to each rotary cleaning unit.

Further, the present invention provides a nozzle for a cleaner that can prevent water in a water tank from leaking outside while air is supplied to the water tank, by installing a gasket on the water tank.

In order to achieve the objects, a nozzle for a cleaner of the present invention may include: a nozzle main body having an intake channel for suctioning air; a rotary cleaning unit rotatably disposed under the nozzle main body and having a rotary plate to which a dust cloth can be attached;

and a driving device disposed in the nozzle body and including a driving motor for driving the rotary cleaning unit.

The rotary cleaning unit may include a first rotary cleaning unit and a second cleaning unit that are spaced apart from each other in a left-right direction under the nozzle main body.

The driving device may include a first driving device disposed at a side of a channel extending in a front-rear direction of the suction nozzle to drive the first rotary cleaning unit, and a second driving device disposed at the other side of the channel extending in the front-rear direction of the suction nozzle to drive the second rotary cleaning unit.

Further, the nozzle for a cleaner of the present invention, in order to be able to supply water to the rotary cleaning units, may include: a water tank for storing water to be supplied to the rotary cleaning units; and a water supply channel disposed in the nozzle main body and communicating with the water tank to supply water to the water tank and to the rotary cleaning units.

A water pump, driven by a pump motor to pump the water in the water tank to the dust cloth, may be disposed in the water supply channel.

The water supply channel may include: a supply pipe through which water discharged from an exhaust port of the water tank flows; a connector connected to the supply pipe; a first diverging pipe connected to the connector to supply water to the first rotary cleaning unit; and a second diverting pipe connected to the connector to supply water to the second rotary cleaning unit.

A spray nozzle may be disposed at each of the first diverging pipe and the second diverging pipe, and nozzle ends of the spray nozzles may be disposed to face the respective rotary cleaning units.

The supply pipe may include: a first supply pipe connected to an inlet of the water pump; and a second supply pipe connected to an outlet of the water pump and the connector.

The intake channel may include: a first channel extending in the left-right direction from the front end of the nozzle main body; and a second channel extending in the front-rear direction from the center of the first channel, in which the second channel may separate the nozzle body to the left and right, and the exhaust port and the water pump may be positioned at the left and right sides of the second channel.

The connector may be positioned above the second channel.

The water pump may include: an outer chamber having a first intake port at a side through which water discharged from the water tank flows inside, and having first and second exhaust ports at upper and lower portions of the other side; an inner chamber formed in the outer chamber, the inner chamber having a third exhaust port at a side through which water is discharged to the dust cloth and third and fourth intake ports formed at an upper portion and a lower portion through which water flows inside; a compression member mounted at the other side of the outer chamber, the compression member sending out water discharged through first and second exhaust ports to the third and fourth intake ports, and the compression member being made of an elastic material; first and second valve members opening/closing the first and second exhaust ports at the other sides of the first and second exhaust ports; and third and fourth valve members opening/closing the third and fourth intake ports at a side of the third and fourth intake ports.

The compression member may include a first compression chamber, covering the first exhaust port and the third intake port at the other side of the outer chamber, and a second compression chamber, covering the second exhaust port and the fourth intake port.

The compression member may further include a vertical plate having a flat plate shape and fixed to the other ends of the first combustion chamber and the second combustion chamber, and a shaft horizontally extending from the center of the vertical plate.

The compression member may further include a driving unit rotatably connected to an end of the shaft and moving vertically up/down, or rotating the end of the shaft by reciprocating.

The driving unit may include a pump motor and a power transmission member converting and transmitting a rotation motion of the pump motor into a reciprocation motion.

The power transmission member may include a rotary member connected to the pump motor to rotate, a first link member eccentrically rotatably coupled to the rotary member, and a second link member having an end rotatably fixed to the first link member and the other end rotatably fixed to the shaft.

The water tank may include: a tank body having a chamber for storing water and an exhaust port for discharging water; and a valve having an opening/closing portion that opens/closes the exhaust port in the tank body. The nozzle main body may include a valve operation unit operating the opening/closing portion such that the opening/closing portion opens the exhaust port when the water tank is mounted on the nozzle main body, and the water supply channel may be connected to the valve operation unit.

The dust cloth may be attached to the bottom of the rotary plate, and a plurality of water passage holes for passing water discharged from the water supply channel may be formed in the rotary plate.

The plurality of water passage holes may be spaced and arranged apart from each other circumferentially with respect to a rotation center of the rotary plate.

One or more air holes for receiving external air may be formed at the water tank and a gasket having a slit may be forcibly fitted in the air holes.

The slit may be opened when the water in the water tank is forcibly discharged, and may be closed when the water in the water tank is not discharged.

DETAILED DESCRIPTION OF THE INVENTION

Figure 1:
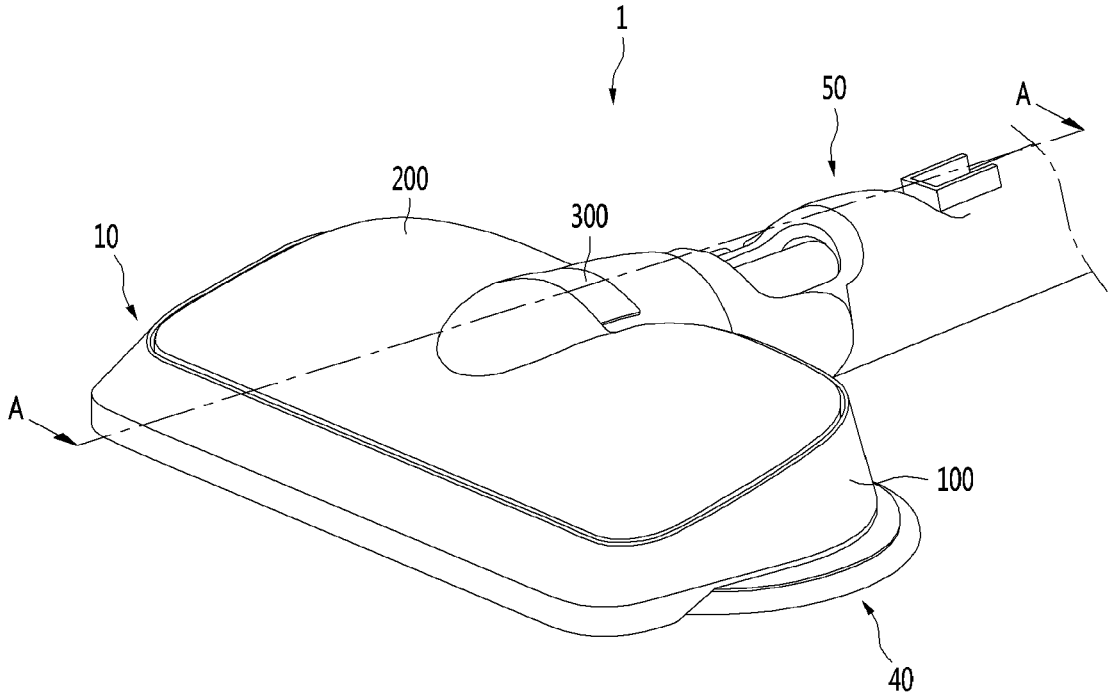
FIG. 1 is a perspective view of a nozzle for a cleaner according to an embodiment of the present invention.

Hereinafter, embodiments of the present invention are described in detail with reference to the exemplary drawings. It should be noted that when components are given reference numerals in the drawings, the same components are given the same reference numerals even if they are shown in different drawings. Further, in the following description of embodiments of the present invention, when detailed description of well-known configurations or functions is determined as interfering with understanding of the embodiments of the present invention, they are not described in detail.

Terms 'first', 'second', 'A', '(a)', and '(b)' can be used in the following description of the components of the embodiments of the present invention. The terms are provided only for discriminating the components from other components and, the essence, sequence, or order of the components are not limited by the terms. When a component is described as being "connected", "combined", or "coupled" with another component, it should be understood that the component may be connected or coupled to another component directly or with another component interposing therebetween.

Figure 2:
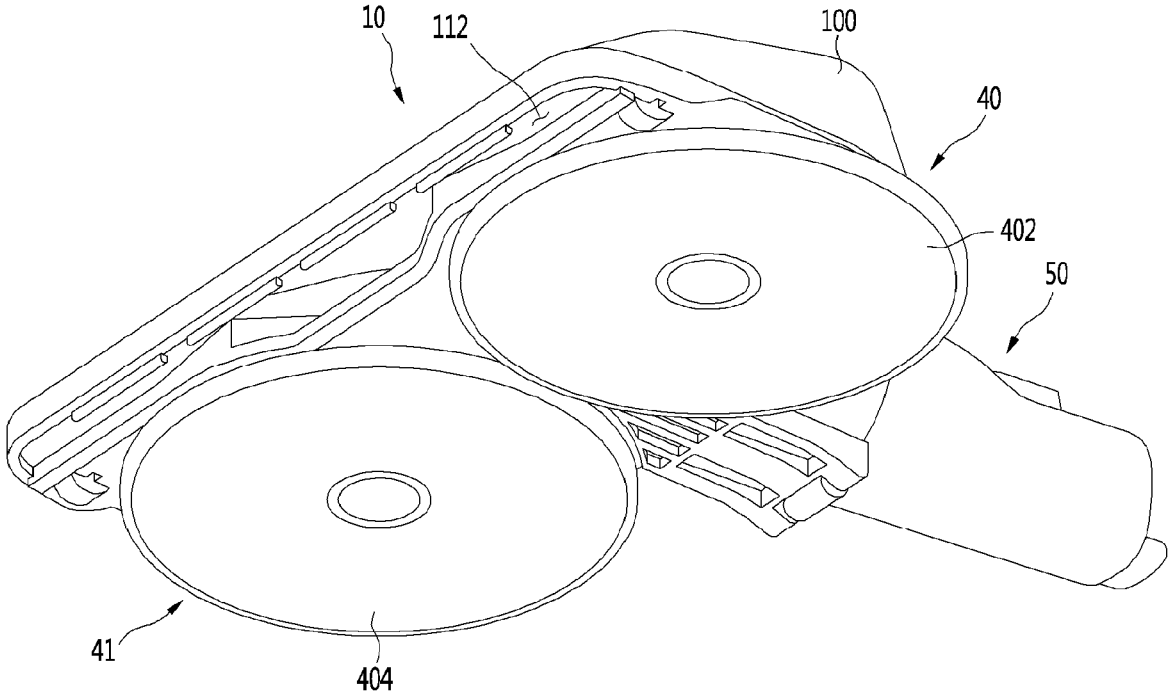
FIG. 2 is another perspective view of a nozzle for a cleaner according to an embodiment of the present invention.
Figure 3:
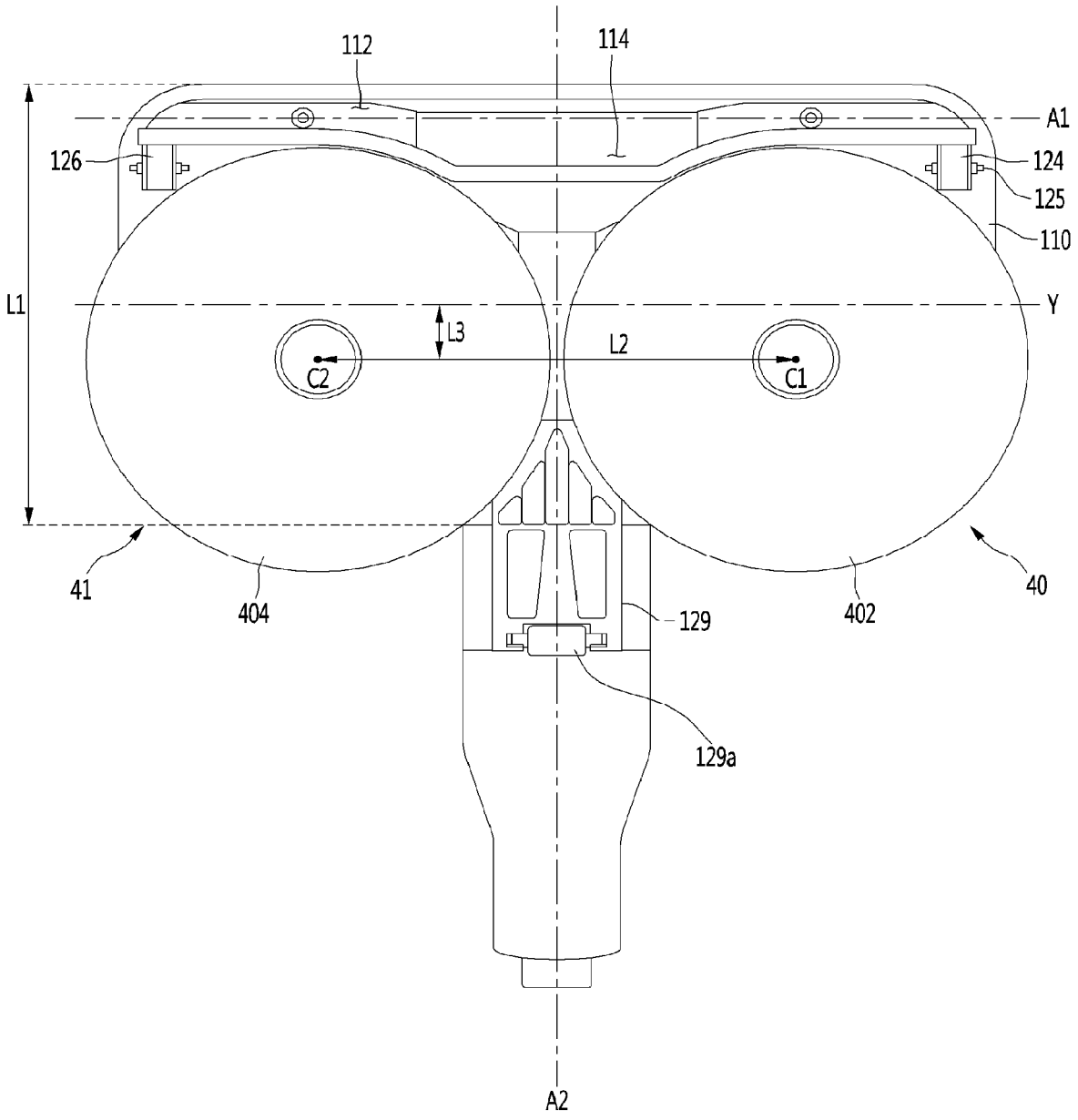
FIG. 3 is a bottom view of a nozzle for a cleaner according to an embodiment of the present invention.
Figure 4:
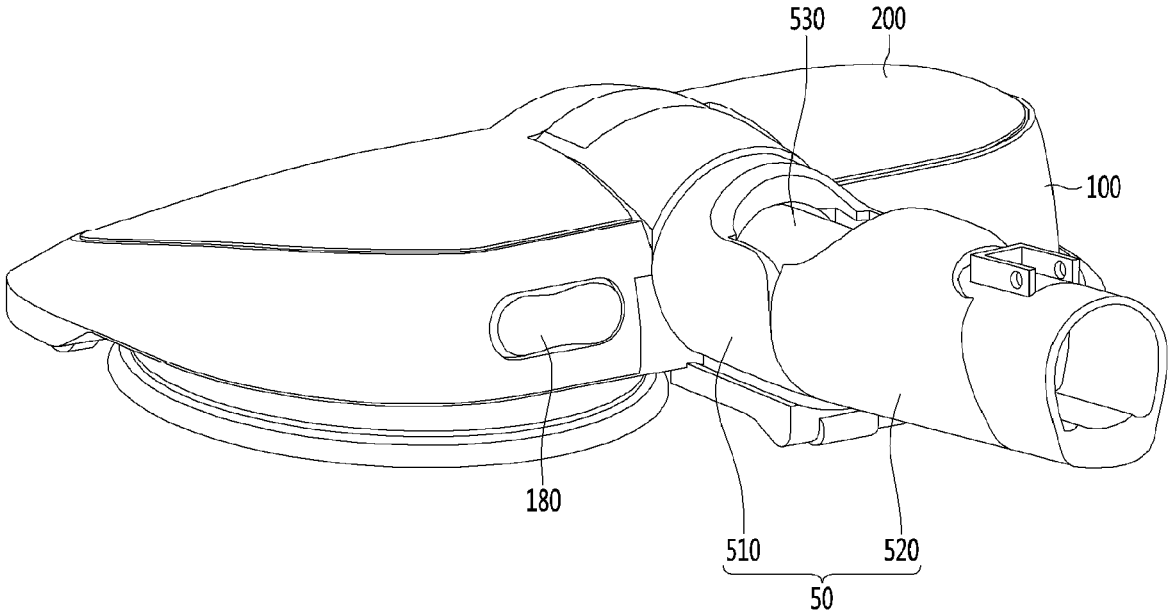
FIG. 4 is a perspective view of the nozzle for a cleaner of FIG. 1 seen from the rear.
Figure 5:
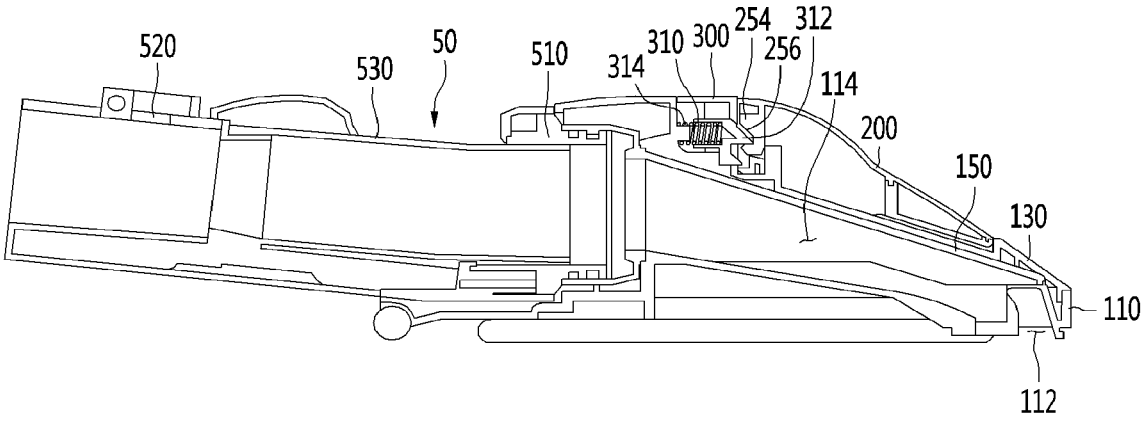
FIG. 5 is a cross-sectional view taken along line A-A of FIG. 1.

FIG. 1 and FIG. 2 are perspective views illustrating a nozzle for a cleaner according to an embodiment of the present invention, FIG. 3 is a bottom view illustrating a nozzle for a cleaner according to an embodiment of the present invention, FIG. 4 is a perspective view illustrating the nozzle for the cleaner of FIG. 1 viewed from the rear side, and FIG. 5 is a sectional view taken along line A-A of FIG. 1.

Referring to FIG. 1 to FIG. 5, a nozzle 1 of a cleaner (hereinafter referred to as "nozzle") according to an embodiment of the present invention includes a nozzle main body 10, and a connection tube 50 which is connected to the nozzle main body 10 so as to be capable of moving.

The nozzle 1 of the present embodiment can be used, for example, in a state of being connected to a handy type cleaner or connected to a canister type cleaner.

The nozzle 1 itself has a battery to supply power to the power consumption unit, or can be operated by receiving power from the cleaner.

Since the cleaner to which the nozzle 1 is connected includes a suction motor, a suction force generated by the suction motor applies to the nozzle 1 to be capable of suctioning foreign matter and air on the bottom surface at the nozzle 1.

Accordingly, in the present embodiment, the nozzle 1 can perform a function of suctioning foreign matter and air on the floor and guiding the foreign matter and air to the cleaner.

Although not limited thereto, the connection tube 50 is connected to the rear central portion of the nozzle main body 10 to guide the suctioned air to the cleaner.

The nozzle 1 may further include rotation cleaning units 40 and 41 rotatably disposed below the nozzle main body 10.

For example, a pair of rotation cleaning units 40 and 41 may be arranged in the lateral direction. The pair of rotation cleaning units 40 and 41 can be independently rotated. For example, the nozzle 1 may include a first rotation cleaning unit 40 and a second rotation cleaning unit 41.

Each of the rotation cleaning units 40 and 41 may include mops 402 and 404. The mops 402 and 404 may be formed in a disc shape, for example. The mops 402 and 404 may include a first mop 402 and a second mop 404.

The nozzle main body 10 may include a nozzle housing 100 forming an outer shape. The nozzle housing 100 may form suction flow paths 112 and 114 for suctioning air.

The suction flow paths 112 and 114 may include a first flow path 112 extending in the lateral direction in the nozzle housing 100 and a second flow path 114, communicating with the first flow path 112 and extending in the front and rear direction.

The first flow path 112 may be formed at a front end portion of the lower surface of the nozzle housing 100, as an example.

The second flow path 114 may extend rearward from the first flow path 112. For example, the second flow path 114 may extend rearward from the central portion of the first flow path 112 toward the connection tube 50.

Accordingly, a centerline A1 of the first flow path 112 can extend in the lateral horizontal direction. A centerline A2 of the second flow path 114 can extend in the front and rear direction and intersect the centerline A1 of the first flow path 112.

The centerline A2 of the second flow path 114 may be positioned at a position where the nozzle main body 10 is bisected right and left, as an example.

A portion of the mops 402 and 404 may protrude to the outside of the nozzle 1 in a state where the rotation cleaning units 40 and 41 are connected to the lower side of the nozzle main body 10, and thus, the rotation cleaning units 40 and 41 can clean not only a floor positioned directly below the nozzle 1, but also the floor positioned outside the nozzle 1.

For example, the mops 402 and 404 may protrude not only to both sides of the nozzle 1, but also to the rear of the nozzle 1.

The rotation cleaning units 40 and 41 may be positioned on the rear side of the first flow path 112 from below the nozzle main body 10, for example.

Therefore, when the nozzle 1 is advanced and cleaned, the floor can be cleaned by the mops 402, 404 after foreign substances and air on the floor are suctioned by the first flow path 112.

In the present embodiment, the first rotation center C1 of the first rotation cleaning unit 40 (for example, rotation center of rotation plate 420) and the second rotation center C2 of the second rotation cleaning unit 41 (for example, rotation center of rotation plate 440) are disposed in a state of being spaced apart from each other in the lateral direction.

The centerline A2 of the second flow path 114 may be positioned in a region between the first rotation center C1 and the second rotation center C2.

The central axis Y bisecting the front and rear length L1 of the nozzle main body 10 (except for extension portion) can be positioned forward of the rotation centers C1 and C2 of the respective rotation cleaning units 40 and 41.

That is, a central axis Y that divides the front-rear length L1 of the nozzle main body 10 into two equal parts may be positioned closer to the front end of the nozzle main body 10 than the rotational centers C1 and C2 of the cleaning units 40 and 41. This is for preventing the rotary cleaning units 40 and 41 from blocking the first channel 114.

Accordingly, the distance L3 between the central axis Y and the rotation centers C1 and C2 of the respective rotation cleaners 40 and 41 may be set to a value greater than zero.

In addition, the distance L2 between the rotation centers C1 and C2 of the rotation cleaning units 40 and 41 may be larger than the diameter of each of the mops 402 and 404. This is to prevent the mops 402 and 404 from interfering with each other during rotation and to prevent the area, which can be cleaned by the interfered portion, from being reduced.

The diameters of the mops 402 and 404 are preferably 0.6 times or more than half the width of the nozzle main body 10, although not limited thereto. In this case, the area where the mops 402 and 404 can clean the floor facing the nozzle main body 10 is increased, and the area for cleaning the floor not facing the nozzle main body 10 is also increased. In addition, the cleaning area by the mops 402 and 404 can be secured even with a small amount of movement when the nozzle 1 is used for cleaning.

In addition, the mops 402, 404 may be provided with sewing lines 405. The sewing lines 405 may be positioned in a state of being spaced apart inwardly in the center direction at the edge portions of the mops 402 and 404. The mops 402 and 404 may be formed by combining a plurality of fiber materials, and the fiber materials may be joined by the sewing lines 405.

At this time, the diameters of the rotation plates 420 and 440, which will be described later, may be larger than the distance to a portion of the sewing lines 405 relative to the centers of the mops 402 and 404. The diameters of the rotation plates 420 and 440 may be smaller than the outer diameters of the mops 402 and 404.

In this case, the rotation plates 420 and 440 can support a portion of the mops 402 and 404 positioned outside the sewing lines 405, thereby reducing the distance between the mops 402 and 404, and it is possible to prevent mutual friction between the mops 402 and 404 or vertical overlapping between the mops 402 and 404 due to the deformation of the mops 402 and 404 by pressing the edge portions.

The nozzle housing 100 may include a nozzle base 110 and a nozzle cover 130 coupled to the upper side of the nozzle base 110.

The nozzle base 110 may form the first flow path 112. The nozzle housing 100 may further include a flow path forming portion 150 forming the second flow path 114 together with the nozzle base 110.

The flow path forming portion 150 may be coupled to the upper center portion of the nozzle base 110, and the end portion of the flow path forming portion 150 may be connected to the connection tube 50.

Accordingly, since the second flow path 114 can extend substantially in a straight line shape in the front and rear direction by the disposition of the flow path forming portion 150, the length of the second flow path 114 can be minimized, and thus the flow path loss in the nozzle 1 can be minimized.

The front portion of the flow path forming portion 150 may cover the upper side of the first flow path 112. The flow path forming portion 150 may be disposed to be inclined upward from the front end portion toward the rear side.

Therefore, the height of the front portion of the flow path forming portion 150 may be lower than that of the rear portion of the flow path forming portion 150.

According to the present embodiment, since the height of the front portion of the flow path forming portion 150 is low, there is an advantage that the height of the front portion of the entire height of the nozzle 1 can be reduced. The lower the height of the nozzle 1, the more likely it is that the nozzle 1 can be drawn into a narrow space on the lower side of a furniture or a chair to be cleaned.

The nozzle base 110 may include an extension portion 129 for supporting the connection tube 50. The extension portion 129 may extend rearward from the rear end of the nozzle base 110.

The connection tube 50 may include a first connection tube 510 connected to an end of the flow path forming portion 150, a second connection tube 520 rotatably connected to the first connection tube 510, and a guide tube 530 for communicating the first connection tube 510 with the second connection tube 520.

The first connection tube 510 may be seated on the extension portion 129 and the second connection tube 520 may be connected to an extension tube or hose of the cleaner.

A plurality of rollers for smooth movement of the nozzle 1 may be provided on the lower side of the nozzle base 110.

For example, the first roller 124 and the second roller 126 may be positioned behind the first flow path 112 on the nozzle base 110. The first roller 124 and the second roller 126 may be spaced apart from each other in the lateral direction.

According to the present embodiment, the first roller 124 and the second roller 126 are disposed behind the first flow path 112 so that the first flow path 112 can be positioned as close as possible to the front end portion of the nozzle base 110 and thus the area which can be cleaned by using the nozzle 1 can be increased.

As the distance from the front end portion of the nozzle base 110 to the first flow path 112 increases, the area in which the suction force does not apply in front of the first flow path 112 during the cleaning process increases, and thus the area where the cleaning is not performed is increased.

On the other hand, according to the present embodiment, the distance from the front end portion of the nozzle base 110 to the first flow path 112 can be minimized, and thus the cleanable area can be increased.

In addition, by disposing the first roller 124 and the second roller 126 behind the first flow path 112, the length of the first flow path 112 in the lateral direction can be maximized.

In other words, the distance between both end portions of the first flow path 112 and both end portions of the nozzle base 110 can be minimized.

In the present embodiment, the first roller 124 may be positioned in a space between the first flow path 112 and the first mop 402. The second roller 126 may be positioned in a space between the first flow path 112 and the second mop 404.

The first roller 124 and the second roller 126 may be rotatably connected to a shaft 125, respectively. The shaft 125 may be fixed to the lower side of the nozzle base 110 in a state of being disposed so as to extend in the lateral direction.

The distance between the shaft 125 and the front end portion of the nozzle base 110 is longer than the distance between the front end portion of the nozzle base 110 and each of the mops 402 and 404 (or a rotation plate described later).

At least a portion of each of the rotation cleaning units 40 and 41 (mop and/or rotation plate) can be positioned between the shaft 125 of the first roller 124 and the shaft 125 of the second roller 126.

According to this disposition, the rotation cleaning units 40 and 41 can be positioned as close as possible to the first flow path 112, and the area to be cleaned by the rotation cleaning units 40 and 41 of the floor on which the nozzle 1 is positioned can be increased, and thus the floor cleaning performance can be improved.

The plurality of rollers are not limited, but the nozzle 1 can be supported at three points. In other words, the plurality of rollers may further include a third roller 129*a* provided on the extension portion 129 of the nozzle base 110.

The third roller 129*a* may be positioned behind the mops 402, 404 to prevent interference with the mops 402, 404.

Meanwhile, the nozzle main body 10 may further include a water tank 200 to supply water to the mops 402 and 404.

The water tank 200 may be detachably connected to the nozzle housing 100. The water in the water tank 200 can be supplied to each of the mops 402 and 404 in a state where the water tank 200 is mounted on the nozzle housing 100.

The nozzle main body 10 may further include an operating unit 300 that operates to separate the nozzle main body 10 in a state where the water tank 200 is mounted on the nozzle housing 100.

The operating unit 300 may be provided in the nozzle housing 100 as an example. The nozzle housing 100 may be provided with a first coupling unit 310 for coupling with the water tank 200 and the water tank 200*a* may be provided with a second coupling unit 254 for coupling with the first coupling unit 310.

The operating unit 300 may be disposed so as to be capable of vertically moving in the nozzle housing 100. The first coupling unit 310 can be moved under the operation force of the operating unit 300 at the lower side of the operating unit 300.

For example, the first coupling unit 310 may move in the front and rear direction. For this purpose, the operating unit 300 and the first coupling unit 310 may include inclined surfaces contacting each other.

When the operating unit 300 is lowered by the inclined surfaces, the first coupling unit 310 can move horizontally (for example, movement in the front and rear direction).

The first coupling unit 310 includes a hook 312 for engaging with the second coupling unit 254 and the second coupling unit 254 includes a groove 256 for inserting the hook 312.

The first coupling unit 310 may be resiliently supported by the elastic member 314 so as to maintain a state where the first coupling unit 310 is coupled to the second coupling unit 254.

Therefore, when the hook 312 is in a state of being inserted into the groove 256 by the elastic member 314 and the operating unit 300 is pressed downward, the hook 312 is separated from the groove 256. The water tank 200 can be separated from the nozzle housing 100 in a state where the hook 312 is removed from the groove 256.

In the present embodiment, the operating unit 300 may be positioned directly above the second flow path 114, for example. For example, the operating unit 300 may be disposed to overlap the centerline A2 of the second flow path 114 in the vertical direction.

Meanwhile, the nozzle main body 10 may further include an adjusting unit 180 for adjusting the amount of water discharged from the water tank 200. For example, the adjusting unit 180 may be positioned on the rear side of the nozzle main body 10.

The adjusting unit 180 can be operated by a user and the adjusting unit 180 can prevent the water from being discharged from the water tank 200 or the water from being discharged.

Alternatively, the amount of water discharged from the water tank 200 can be adjusted by the adjusting unit 180. For example, when the adjusting unit 180 is operated, water is discharged from the water tank 200 by a first amount per unit time, or water is discharged by a second amount greater than the first amount per unit time.

The adjusting unit 180 may be pivotally mounted to the nozzle main body 10 in a lateral direction or may be pivoted in a vertical direction.

For example, in a state where the adjusting unit 180 is in the neutral position as shown in FIG. 4, the amount of water discharged is 0, and when the left side of the adjusting unit 180 is pushed to pivot the adjusting unit 180 to the left, water may be discharged from the water tank 200 by a first amount per unit time.

When the adjustment unit 180 is pushed to the right by pushing the right side of the adjustment unit 180, the second amount of water may be discharged from the water tank 200 per unit time. The configuration for detecting the operation of the adjusting unit 180 will be described later with reference to the drawings.

Figure 6:
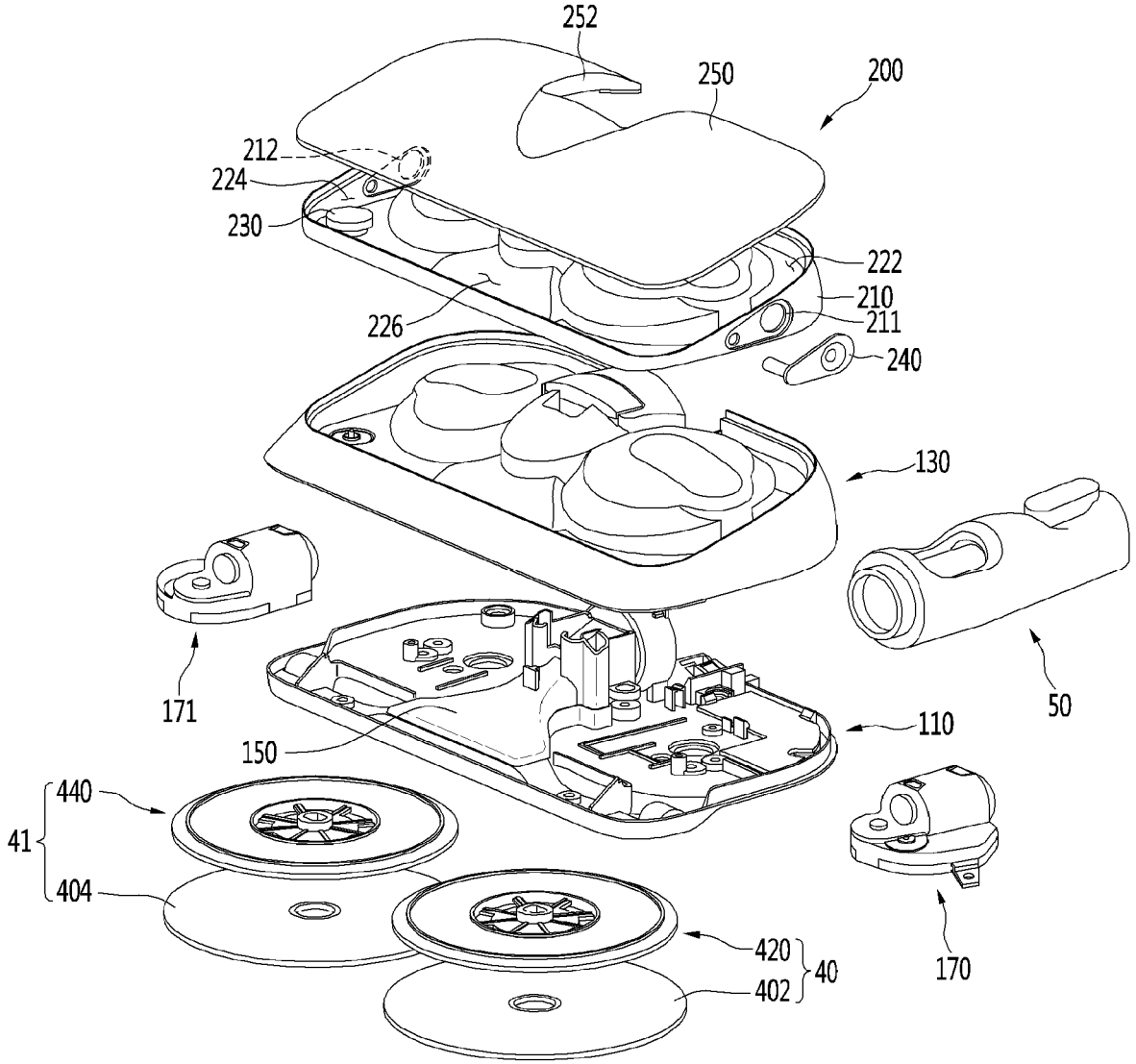
FIG. 6 is an exploded perspective view of a nozzle according to an embodiment of the present invention.
Figure 7:
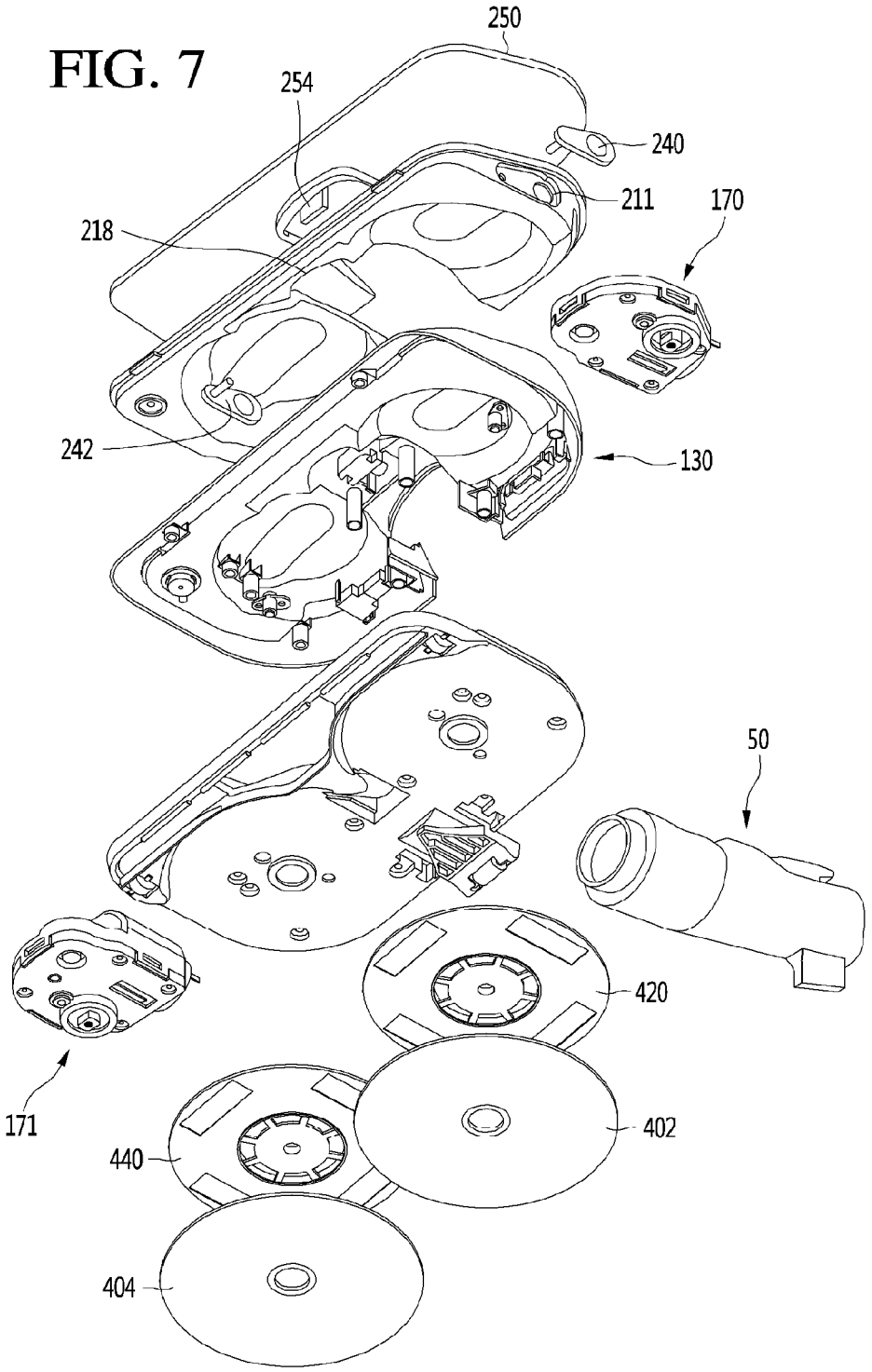
FIG. 7 is another exploded perspective view of a nozzle according to an embodiment of the present invention.
Figure 8:
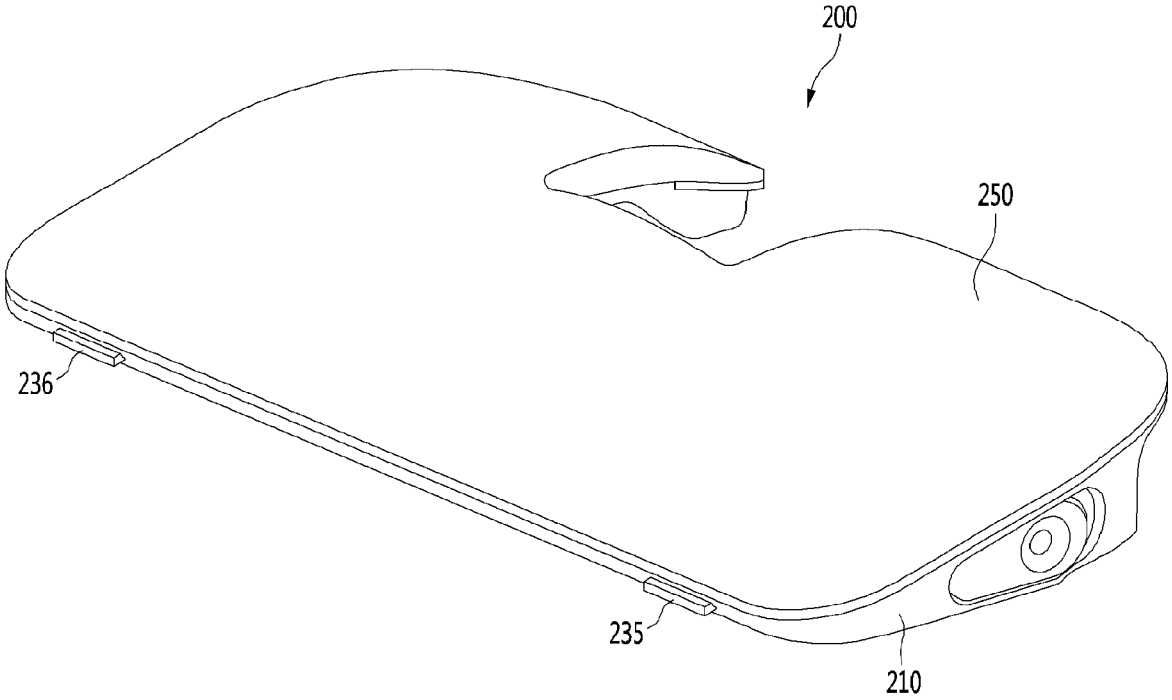
FIG. 8 is a perspective view of a water tank according to an embodiment of the present invention.
Figure 9:
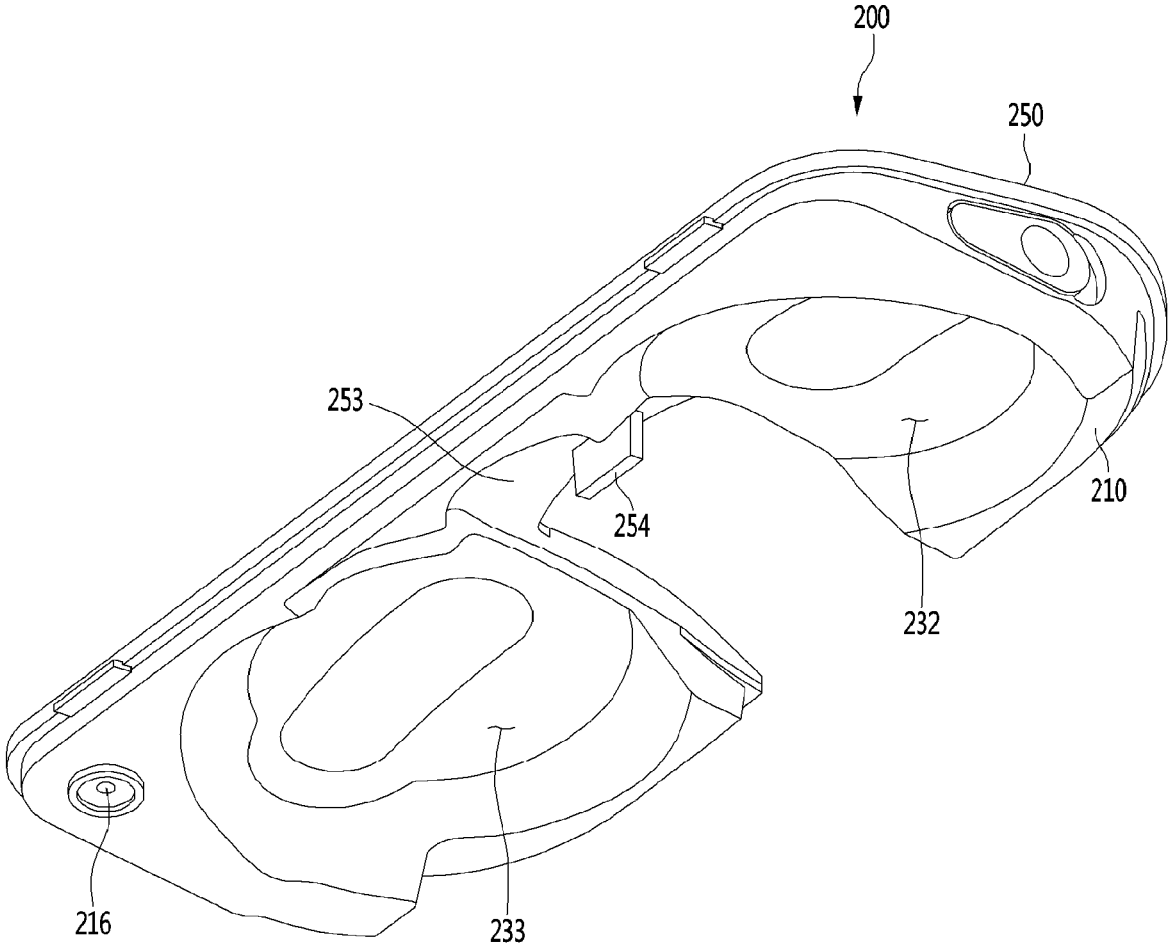
FIG. 9 is another perspective view of a water tank according to an embodiment of the present invention.

FIG. 6 and FIG. 7 are exploded perspective views of a nozzle according to an embodiment of the present invention, and FIG. 8 and FIG. 9 are perspective views of a water tank according to an embodiment of the present invention.

Referring to FIG. 3 and FIG. 6 to FIG. 9, the nozzle main body 10 may further include a plurality of driving devices 170 and 171 for individually driving the respective rotation cleaning units 40 and 41.

The plurality of driving devices 170 and 171 may include a first driving device 170 for driving the first rotation cleaning unit 40 and a second driving device 171 for driving the second rotation cleaning unit 41.

Since each of the driving devices 170 and 171 operates individually, even if some of the driving devices 170 and 171 fail, there is an advantage that some of the rotation cleaning devices can be rotated by another driving device.

The first driving device 170 and the second driving device 171 may be spaced apart from each other in the lateral direction in the nozzle main body 10.

The driving devices 170 and 171 may be positioned behind the first flow path 112.

For example, at least a portion of the second flow path 114 may be positioned between the first driving device 170 and the second driving device 171. Therefore, even if the plurality of driving devices 170 and 171 is provided, the second flow path 114 is not affected, and thus the length of the second flow path 114 can be minimized.

According to the present embodiment, since the first driving device 170 and the second driving device 171 are disposed on both sides of the second flow pathway 114, the weight of the nozzle 1 can be uniformly distributed to the left and right so that it is possible to prevent the center of gravity of the nozzle 1 from being biased toward any one side of the nozzle 1.

The plurality of driving devices 170 and 171 may be disposed in the nozzle main body 10. For example, the plurality of driving devices 170 and 171 may be seated on the upper side of the nozzle base 110 and covered with the nozzle cover 130. In other words, the plurality of driving devices 170 and 171 may be positioned between the nozzle base 110 and the nozzle cover 130.

Each of the rotation cleaning units 40 and 41 may further include rotation plates 420 and 440 which are rotated by receiving power from each of the driving devices 170 and 171.

The rotation plates 420 and 440 may include a first rotation plate 420 which is connected to the first driving device 170 and to which the first mop 402 is attached and a second rotation plate 420 which is connected to the second driving device 171 and a second rotation plate 440 to which the second mop 404 is attached.

The rotation plates 420 and 440 may be formed in a disc shape, and the mops 402 and 404 may be attached to the bottom surfaces of the rotation plates 420 and 440.

The rotation plates 420 and 440 may be connected to each of the driving devices 170 and 171 on the lower side of the nozzle base 110. In other words, the rotation plates 420 and 440 may be connected to the driving devices 170 and 171 at the outside of the nozzle housing 100.

<Water Tank>

The water tank 200 may be mounted on the upper side of the nozzle housing 100. For example, the water tank 200 may be seated on the nozzle cover 130. The water tank 200 can form a portion of an outer appearance of the nozzle main body 10 in a state where the water tank 200 is seated on the upper side of the nozzle cover 130. For example, the water tank 200 may form a portion of an outer appearance of an upper surface of the nozzle main body 10.

The water tank 200 may include a first body 210, and a second body 250 coupled to the first body 210 and defining a chamber in which water is stored together with the first body 210.

The chamber may include a first chamber 222 positioned above the first driving device 170, a second chamber 224 positioned above the second driving device 171, and a connection chamber 226 communicating the first chamber 222 with the second chamber 224 and positioned above the second flow path 114.

In the present invention, the volume of the connection chamber 226 may be formed to be smaller than the volumes of the first chamber 222 and the second chamber 24 so that the amount of water to be stored is increased while minimizing the height of the nozzle 1 by the water tank 200.

The water tank 200 may be formed so that the front height is low and the rear height is high. The upper surface of the water tank 200 may be inclined upward or rounded from the front side to the back side.

For example, the connection chamber 226 may connect the first chamber 222 and the second chamber 224 disposed on both sides in the front portion of the water tank 200. In other words, the connection chamber 226 may be positioned in the front portion of the water tank 200.

The water tank 200 may include a first inlet 211 for introducing water into the first chamber 222 and a second inlet 212 for introducing water into the second chamber 224.

The first inlet 211 may be covered by a first inlet cover 240 and the second inlet 212 may be covered by a second inlet cover 242. For example, each of the inlet covers 242 and 240 may be formed of a rubber material.

Each of the inlets 211 and 212 may be formed on both side surfaces of the first body 210, for example.

The height of both side surfaces of the first body 210 may be the lowest at the front end portion and may become higher toward the rear side.

So as to ensure the size of each of the inlets 211 and 212, each of the inlets 211 and 212 may be positioned closer to the rear end portion than the front end portion at both side surfaces of the first body 210.

The first body 210 may include a first slot 218 for preventing interference with the operating unit 300 and the coupling units 310 and 254. The first slot 218 may be formed such that the center rear end portion of the first body 210 is depressed forward.

In addition, the second body 250 may include a second slot 252 for preventing interference with the operating unit 300. The second slot 252 may be formed such that the center rear end portion of the second body 250 is depressed forward.

The second body 250 may further include a slot cover 253 covering a portion of the first slot 218 of the first body 210 in a state of being coupled to the first body 210. In other words, the front and rear length of the second slot 252 is shorter than the front and rear length of the first slot 218.

The second coupling unit 254 may extend downward from the slot cover 253. Accordingly, the second coupling unit 254 may be positioned within the space formed by the first slot 218.

The water tank 200 may further include coupling ribs 235 and 236 for coupling with the nozzle cover 130 before the second coupling unit 254 of the water tank 200 is coupled with the first coupling unit 310.

The coupling ribs 235 and 236 also perform a role which guides the coupling position of the water tank 200 in the nozzle cover 130 before the second coupling unit 254 of the water tank 200 is coupled with the first coupling unit 310. For example, a plurality of coupling ribs 235 and 236 protrude from the first body 110 and may be disposed so as to be spaced apart in the left and right horizontal direction.

Though not limited, the plurality of coupling ribs 235 and 236 may protrude forward from the front surface of the first body 210 and may be spaced apart from each other in the lateral direction.

Since the driving devices 170 and 171 are disposed in the nozzle main body 10, the nozzle main body 10 may partially protrude upward at both sides of the second channel 114 respectively by the driving devices 170 and 171.

The water tank 200 may have a pair of receiving spaces 232 and 233 to prevent interference with the portions protruding from the nozzle main body 10. The pair of receiving spaces 232 and 233, for example, may be formed by recessing upward a portion of the first body 210. The pair of receiving spaces 232 and 233 may be separated left and right by the first slot 218.

The water tank 200 may further include a discharge port 216 through which water is discharged.

The discharge port 216 may be formed on the lower surface of the first body 210, for example.

The discharge port 216 may be opened or closed by a valve 230. The valve 230 may be disposed in the water tank 200. The valve 230 can be operated by an external force, and the valve 230 maintains a state where the discharge port 216 is closed as long as no external force is applied. Therefore, water can be prevented from being discharged from the water tank 200 through the discharge port 216 in a state where the water tank 200 is separated from the nozzle main body 10.

In the present embodiment, the water tank 200 may include a single discharge port 216. The discharge port 216 may be positioned below one of the first chamber 222 and the second chamber 224. In other words, the discharge port 216 can be positioned close to any one of the pair of receiving spaces 232 and 233.

The reason why the water tank 200 is provided with the single discharge port 216 is to reduce the number of parts that may cause water leakage.

In other words, since there is a component (control board, driving motor, or the like) in the nozzle 1 which receives power and operates, the contact of the component with water must be completely blocked. So as to block the contact between the component and the water, leakage in the portion through which water is discharged at the water tank 200 is basically minimized.

As the number of the discharge ports 216 in the water tank 200 is increased, a structure for preventing water leakage is additionally required so that the structure thereof is complicated. Also, even if there is a structure for preventing water leakage, there is a possibility that water leakage cannot be completely prevented.

In addition, as the number of discharge ports 216 in the water tank 200 is increased, the number of the valves 230 for opening and closing the discharge port 216 is also increased. This means that the number of components is increased and the volume of the chamber for water storage in the water tank 200 is reduced by the valve 230.

Since the height of the rear side of the water tank 200 is higher than that of the front side of the water tank 200, the discharge port 216 is positioned close to the front end portion of the first body 210 so that the water in the water tank 200 can be smoothly discharged.

<Nozzle Cover>

Figure 10:
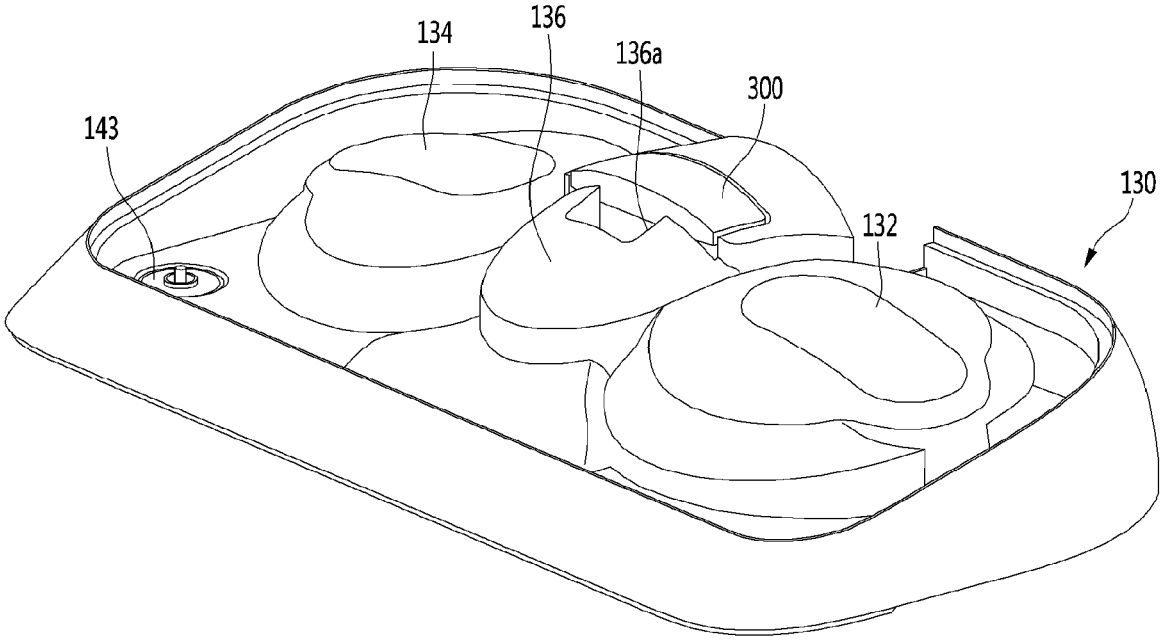
FIG. 10 is a perspective view of a nozzle cover according to an embodiment of the present invention seen from above.
Figure 11:
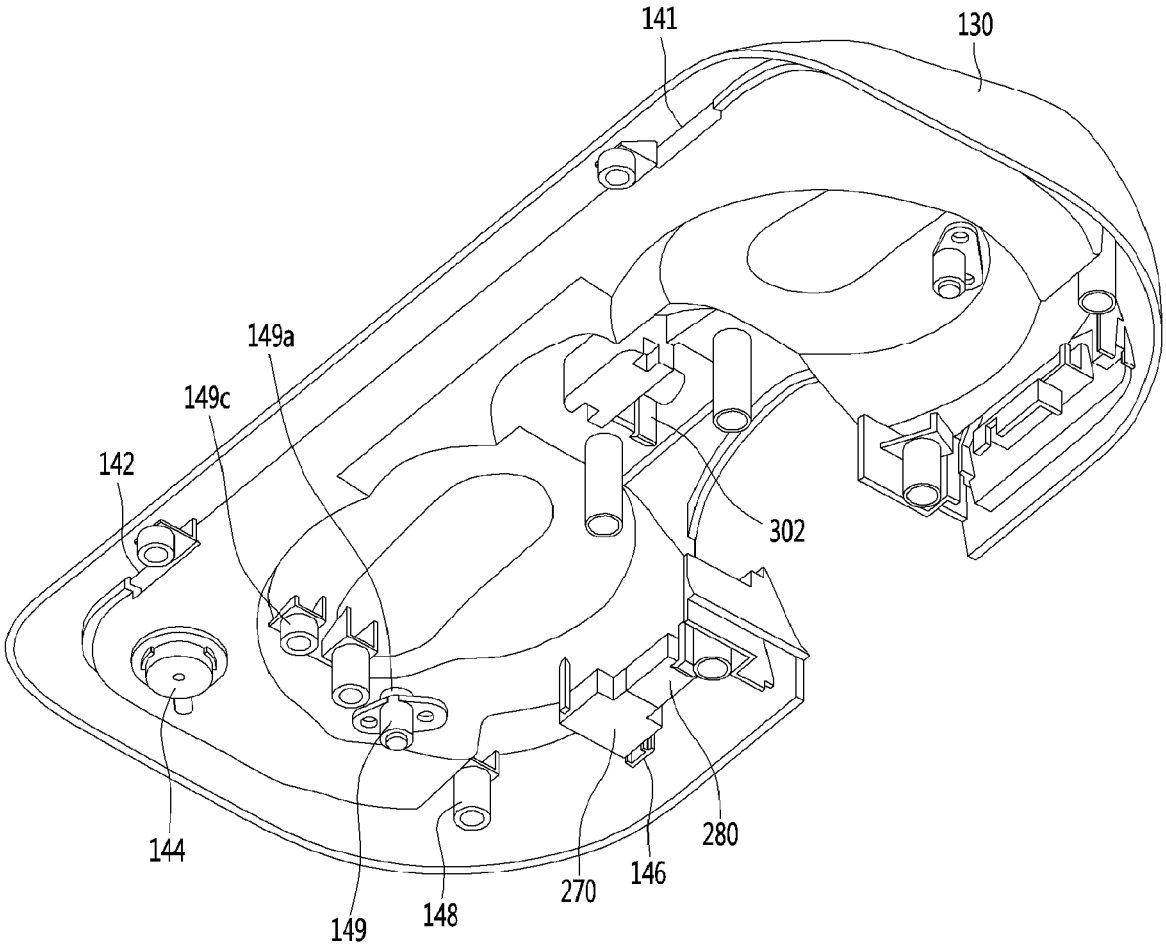
FIG. 11 is a perspective view of a nozzle cover according to an embodiment of the present invention seen from under.

FIG. 10 is a perspective view illustrating a nozzle cover according to an embodiment of the present invention as viewed from above, and FIG. 11 is a perspective view illustrating a nozzle cover according to an embodiment of the present invention as viewed from below.

Referring to FIG. 6, FIG. 10, and FIG. 11, the nozzle cover 130 may include driving unit covers 132 and 134 that cover the upper side of each of the driving units 170 and 171.

Each of the driving unit covers 132 and 134 is a portion which protrudes upward from the nozzle cover 130. Each of the driving unit covers 132 and 134 can surround the upper side of the driving devices 170 and 171 without interfering with each of the driving devices 170 and 171 installed in the nozzle base 110. In other words, the driving unit covers 132 and 134 are spaced apart from each other in the lateral direction in the nozzle cover 130.

When the water tank 200 is seated on the nozzle cover 130, each of the driving unit cover 132 and 134 is received in each of the receiving spaces 232 and 233 of the water tank 200, and thus interference between the components is prevented.

In addition, in the water tank 200, the first chamber 222 and the second chamber 224 may be disposed so as to surround the periphery of each of the respective driving unit covers 132 and 134.

Thus, according to the present embodiment, the volumes of the first chamber 222 and the second chamber 224 can be increased.

The first body 210 of the water tank 200 may be seated at a lower portion of the nozzle cover 130 than the driving unit covers 132 and 134.

At least a portion of the bottom of the water tank 200 may be positioned lower than the axial lines A3 and A4 of driving motors so that a height increase by the water tank 200 is minimized, as will be described later. For example, the bottoms of the first chamber 122 and the second chamber 124 may be positioned lower than the axial lines A3 and A4 of the driving motors to be described below.

The nozzle cover 130 may further include a flow path cover 136 covering the flow path forming portion 150. The flow path cover 136 may be disposed between the driving unit covers 132 and 134 and may be disposed at a position corresponding to the first slot 218 of the water tank 200.

The flow path cover 136 can support the operating unit 300. The operating unit 300 may include a coupling hook 302 for coupling to the flow path cover 136. The operating unit 300 may be coupled to the flow path cover 136 from above the flow path cover 136.

It is possible to prevent the operating unit 300 from being separated upward from the flow path cover 136 in a state where the coupling hook 302 is coupled to the flow path cover 136.

The flow path cover 136 may have an opening 136*a* into which the second coupling unit 254 can be inserted. The first coupling unit 310 may be coupled to the second coupling unit 254 while the second coupling unit 254 of the water tank 200 is inserted into the opening 136*a*.

The flow path cover 136 may be positioned in the first slot 218 of the first body 210 and the second slot 252 of the second body 250.

In the present embodiment, so as to increase the water storage capacity of the water tank 200, a portion of the water tank 200 may be positioned on both sides of the flow path cover 136. Therefore, the water storage capacity of the water tank 200 can be increased while preventing the water tank 200 from interfering with the second flow path 114.

In addition, the highest point of the water tank 200 may be equal to or lower than the highest point of the flow path cover 136 so that the height of the water tank 200 is prevented from increasing.

In addition, so as to prevent the water tank 200 from colliding with structures around the nozzle 1 during the movement of the nozzle 1, the entire water tank 200 can be disposed to overlap with the nozzle housing 100 in the vertical direction. In other words, the water tank 200 may not protrude in the lateral direction and the front and rear direction of the nozzle housing 100.

The nozzle cover 130 may further include rib insertion holes 141 and 142 into which the coupling ribs 235 and 236 provided in the water tank 200 are inserted. The rib insertion holes 141 and 142 may be spaced apart from the nozzle cover 130 in the lateral horizontal direction.

Accordingly, the center or rear portion of the water tank 200 is moved downward in a state where the coupling ribs 235 and 236 are inserted into the rib insertion holes 141 and 142, and thus the second coupling unit 254 may be coupled to the first coupling portion 310.

A valve operation member 144 that can operate a valve 230 in the water tank 200 and through which water can flow may be combined with the nozzle cover 130.

The valve operating unit 144 may be coupled to the lower side of the nozzle cover 130, and a portion of the valve operating unit 144 may protrude upward through the nozzle cover 130.

The valve operating unit 144 protruding upward is introduced in the water tank 200 through the discharge port 216 of the water tank 200 when the water tank 200 is mounted on the nozzle housing 100. In other words, the valve operating unit 144 may be disposed at a position facing the discharge port 216 of the water tank 200.

The valve operating unit 144 will be described later with reference to the drawings.

The nozzle cover 130 may be provided with a sealer 143 for preventing water discharged from the water tank 200 from leaking from the vicinity of the valve operating unit 144. The sealer 143 may be formed of rubber material, for example, and may be coupled to the nozzle cover 130 from above the nozzle cover 130. The discharge port 216 may be in contact with the sealer 143.

The nozzle cover 130 may be provided with a water pump 270 for controlling water discharge from the water tank 200. The water pump 270 may be connected to a pump motor 280.

A pump installation rib 146 for installing the water pump 270 may be provided on the lower side of the nozzle cover 130. The water pump 270 and the pump motor 280 are installed in the nozzle cover 130 so that the pump motor 280 is prevented from contacting the water even if the water drops into the nozzle base 110.

The water pump 270 is a pump that operates so as to communicate the inlet and the outlet by expanding or contracting the valve body therein while being operated, and the pump can be realized by a well-known structure, and thus a detailed description thereof will be omitted.

The valve body in the water pump 270 can be driven by the pump motor 280. Therefore, according to the present embodiment, water in the water tank 200 can be continuously and stably supplied to the rotation cleaning units 40 and 41 while the pump motor 280 is operating.

The operation of the pump motor 280 can be adjusted by operating the above-described adjusting unit 180. For example, the adjusting unit 180 may select the on/off state of the pump motor 280.

Alternatively, the output (or rotational speed) of the pump motor 280 may be adjusted by the adjusting unit 180.

The nozzle cover 130 may further include at least one fastening boss 148 to be coupled with the nozzle base 110.

In addition, the nozzle cover 130 may be provided with a spray nozzle 149 for spraying water to the rotation cleaning units 40 and 41 to be described later. For example, a pair of spray nozzles 149 may be installed on the nozzle cover 130 in a state where the spray nozzles 149 are spaced apart from each other in the lateral direction.

The nozzle cover 130 may be provided with a nozzle installation boss 149*c* for mounting the spray nozzle 149. For example, the spray nozzle 149 may be fastened to the nozzle installation boss 149*c* by a screw.

The spray nozzle 149 may include a connection unit 149*a* for connecting a branch tube to be described later.

<Nozzle Base>

Figure 12:
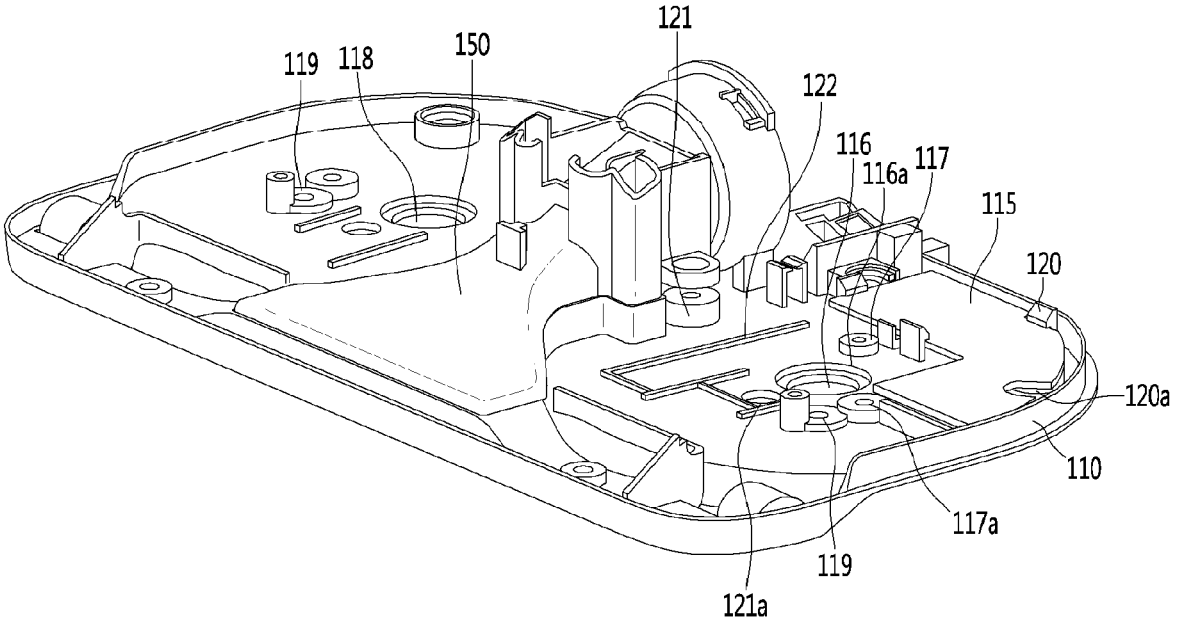
FIG. 12 is a view showing a state when a channel forming unit is combined with a nozzle base according to an embodiment of the present invention.
Figure 13:
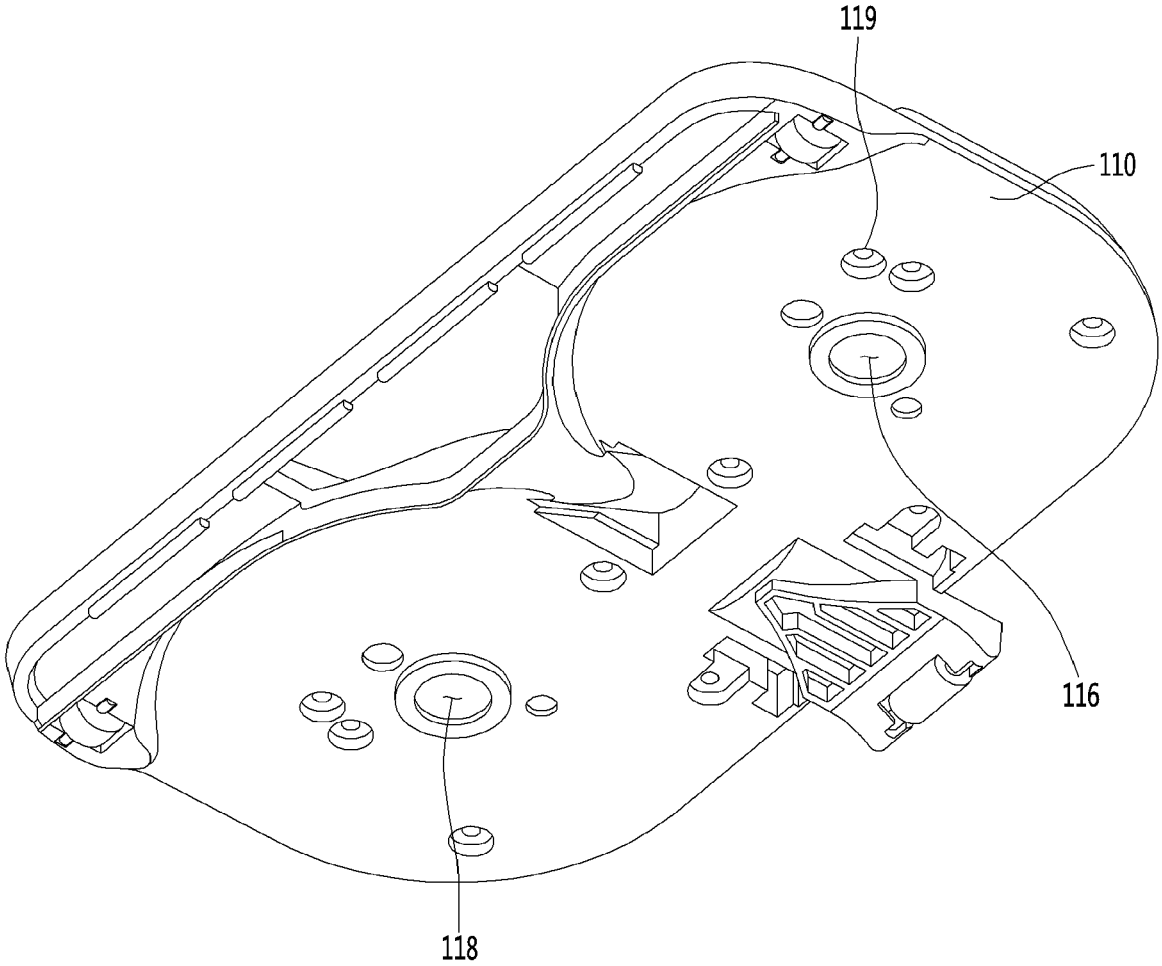
FIG. 13 is a perspective view of a nozzle base according to an embodiment of the present invention seen from under.

FIG. 12 is a view illustrating a state where a flow path forming portion is coupled to a nozzle base according to an embodiment of the present invention, and FIG. 13 is a view illustrating a nozzle base according to an embodiment of the present invention as viewed from below.

Referring to FIG. 6, FIG. 12, and FIG. 13, the nozzle base 110 may include a pair of shaft through-holes 116 and 118 through which a transmission shaft (to be described later) that is connected to each of the rotation plates 420 and 440 in each of the driving devices 170 and 171 passes.

The nozzle base 110 is provided with a seating groove 116*a* for seating a sleeve (to be described later) provided in each of the driving devices 170 and 171, and the shaft through-holes 116 and 118 may be formed in the seating groove 116*a*.

The seating groove 116*a* may be formed in a circular shape, as an example and may be recessed downward from the nozzle base 110. The shaft through-holes 116 and 118 may be formed in the bottom of the seating groove 116*a*.

In the process of moving the nozzle 1 or the operation of the driving devices 170 and 171 as the sleeves (to be described later) provided in the driving devices 170 and 171 are seated in the seating grooves 116*a*, the horizontal movement of the driving devices 170 and 171 can be restricted.

Each of the shaft through-holes 116 and 118 may be disposed on both sides of the flow path forming portion 150 in a state where the flow path forming portion 150 is coupled to the nozzle base 110.

The nozzle base 110 may be provided with a board installation portion 120 for installing a control board 115 for controlling each of the driving devices 170 and 171. For example, the board installation portion 120 may be formed as a hook shape extending upward from the nozzle base 110.

The hooks of the board installation portion 120 are hooked on the upper surface of the control board 115 to restrict upward movement of the control board 115.

The control board 115 may be disposed in a horizontal state. The control board 115 may be installed so as to be spaced apart from the bottom of the nozzle base 110.

The reason is for preventing water from coming in contact with the control board 116 even if water drops to the bottom of the nozzle base 110. To this end, a supporting protrusion 120*a* that supports and spaces the control board 116 apart from the floor may be formed on the nozzle base 110.

The board installation portion 120 may be positioned at one side of the flow path forming portion 150 in the nozzle base 110, although not limited thereto. For example, the control board 115 may be disposed at a position adjacent to the adjusting unit 180.

Therefore, a switch (to be described later) installed on the control board 115 can sense the operation of the adjusting unit 180.

In the present embodiment, the control board 115 may be positioned on the opposite side of the valve operating unit 144 with respect to the second flow path 114. Therefore, even if leakage occurs in the valve operating unit 144, water can be prevented from flowing to a side of the control board 115.

The nozzle base 110 may further include supporting ribs 122 for supporting the lower sides of each of the driving devices 170 and 171 and fastening bosses 117 and 117*a* for fastening each of the driving devices 170 and 171.

The supporting ribs 122 protrude from the nozzle base 110 and are bent at least once to separate each of the driving devices 170 and 171 from the bottom of the nozzle base 110. Alternatively, a plurality of spaced apart supporting ribs 122 may protrude from the nozzle base 110 to separate each of the driving devices 170 and 171 from the bottom of the nozzle base 110.

Even if water falls to the bottom of the nozzle base 110, the driving devices 170 and 171 are spaced apart from the bottom of the nozzle base 110 by the supporting ribs 122 so that it is possible to minimize the flow of water on the side of the drive devices 170, 171.

In addition, the nozzle base 110 may further include a nozzle hole 119 through which each of the spray nozzles 149 passes.

A portion of the spray nozzle 149 coupled to the nozzle cover 130 may pass through the nozzle hole 119 when the nozzle cover 130 is coupled to the nozzle base 110.

In addition, the nozzle base 110 may further include an avoidance hole 121*a* for preventing interference with the structures of each of the driving devices 170 and 171, and a fastening boss 121 for fastening the flow path forming portion 150.

A portion of each of the driving devices 170 and 171 may be positioned in the avoidance hole 121*a* so that the supporting rib 122 may be positioned at the periphery of the avoidance hole 121*a* so as to minimize the flow of water to the avoidance hole 121*a*.

For example, the supporting rib 122 may be positioned in the avoidance hole 121*a* in the formed region.

<Installation Position of a Plurality of Switches>

Figure 14:
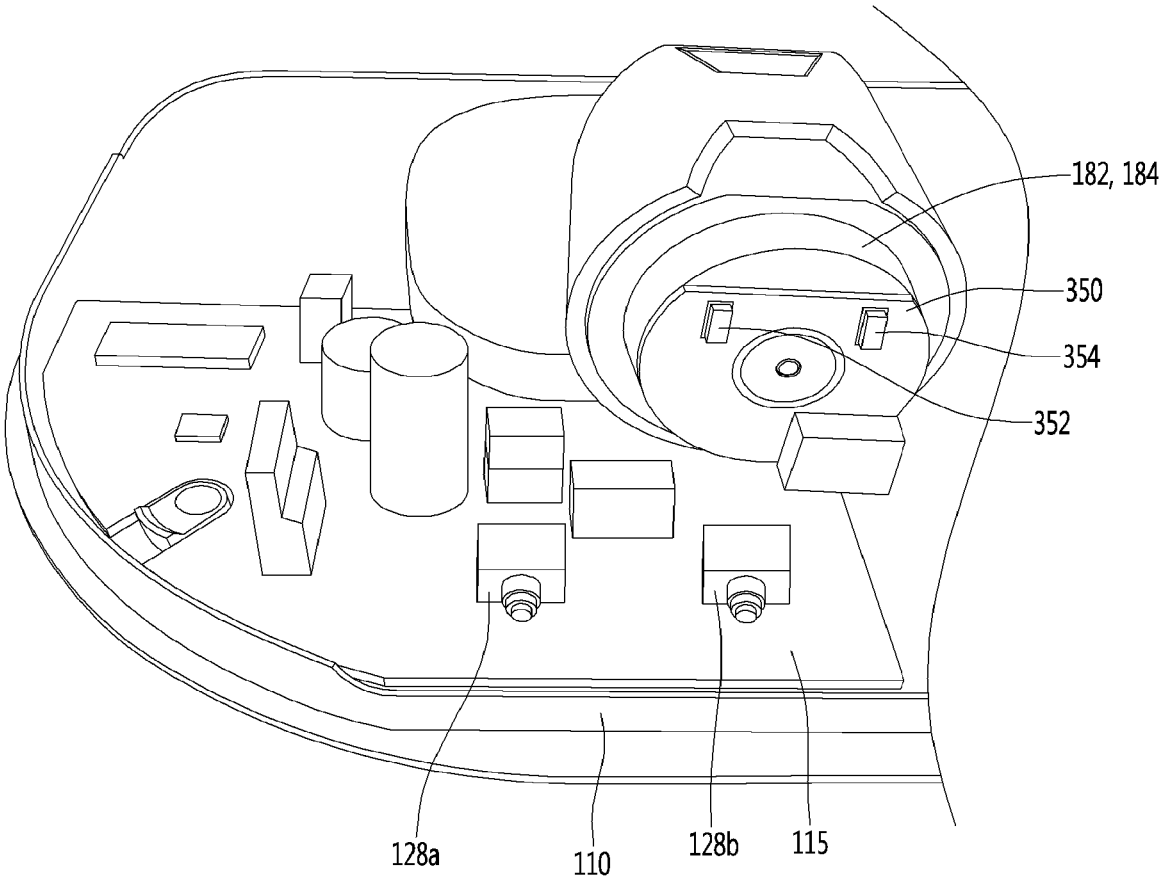
FIG. 14 is a view showing a plurality of switches installed on a control board according to an embodiment of the present invention.

FIG. 14 is a view illustrating a plurality of switches provided on a control board according to an embodiment of the present invention.

Referring to FIG. 4 and FIG. 14, the nozzle base 110 is provided with a control board 115 as described above. A plurality of switches 128*a* and 128*b* may be provided on the upper surface of the control board 115 to sense the operation of the adjusting unit 180.

The plurality of switches 128*a* and 128*b* may be installed in a state of being spaced apart in the lateral direction.

The plurality of switches 128*a* and 128*b* may include a first switch 128*a* for sensing a first position of the adjusting unit 180 and a second switch 128*b* for sensing a second position of the adjusting unit 180.

For example, when the adjusting unit 180 is pivoted to the left and moves to the first position, the adjusting unit 180 presses the contact of the first switch 128*a* to turn on the first switch 128*a*. In this case, the pump motor 280 operates as a first output, and water can be discharged by the first amount per unit time in the water tank 200.

When the adjusting unit 180 pivots to the right and moves to the second position, the adjusting unit 180 presses the contact of the second switch 128*b* so that the second switch 128*b* is turned on.

In this case, the pump motor 280 operates as a second output, which is larger than the first output, so that the water can be discharged by the second amount per unit time in the water tank 200.

When the adjusting unit 180 is positioned at a neutral position between the first position and the second position, the adjusting unit 180 does not press the contacts of the first switch 128*a* and the second switch 128*b*, and the pump motor 280 is stopped.

<Driving Device>

Figure 15:
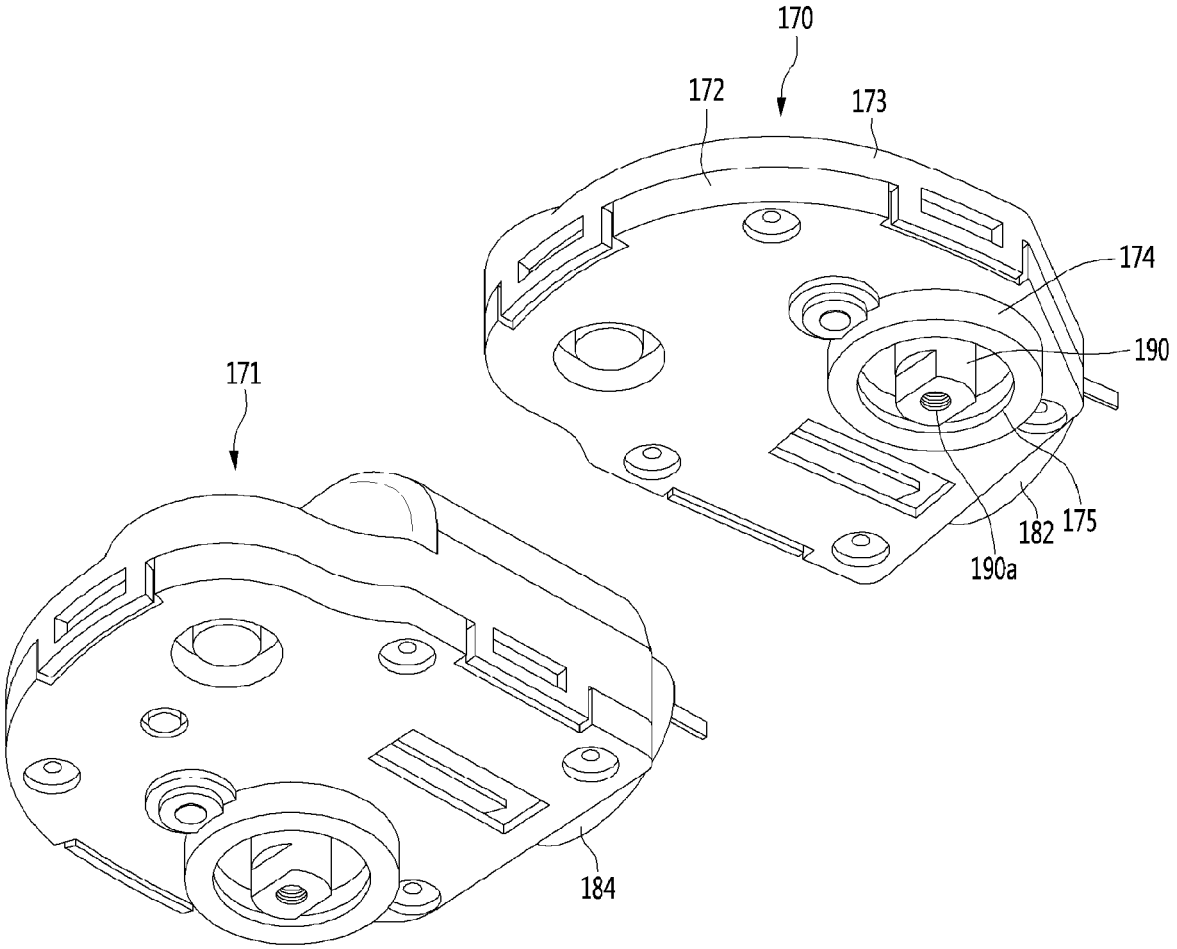
FIG. 15 is a view of first and second driving devices according to an embodiment of the present invention seen from under.
Figure 16:
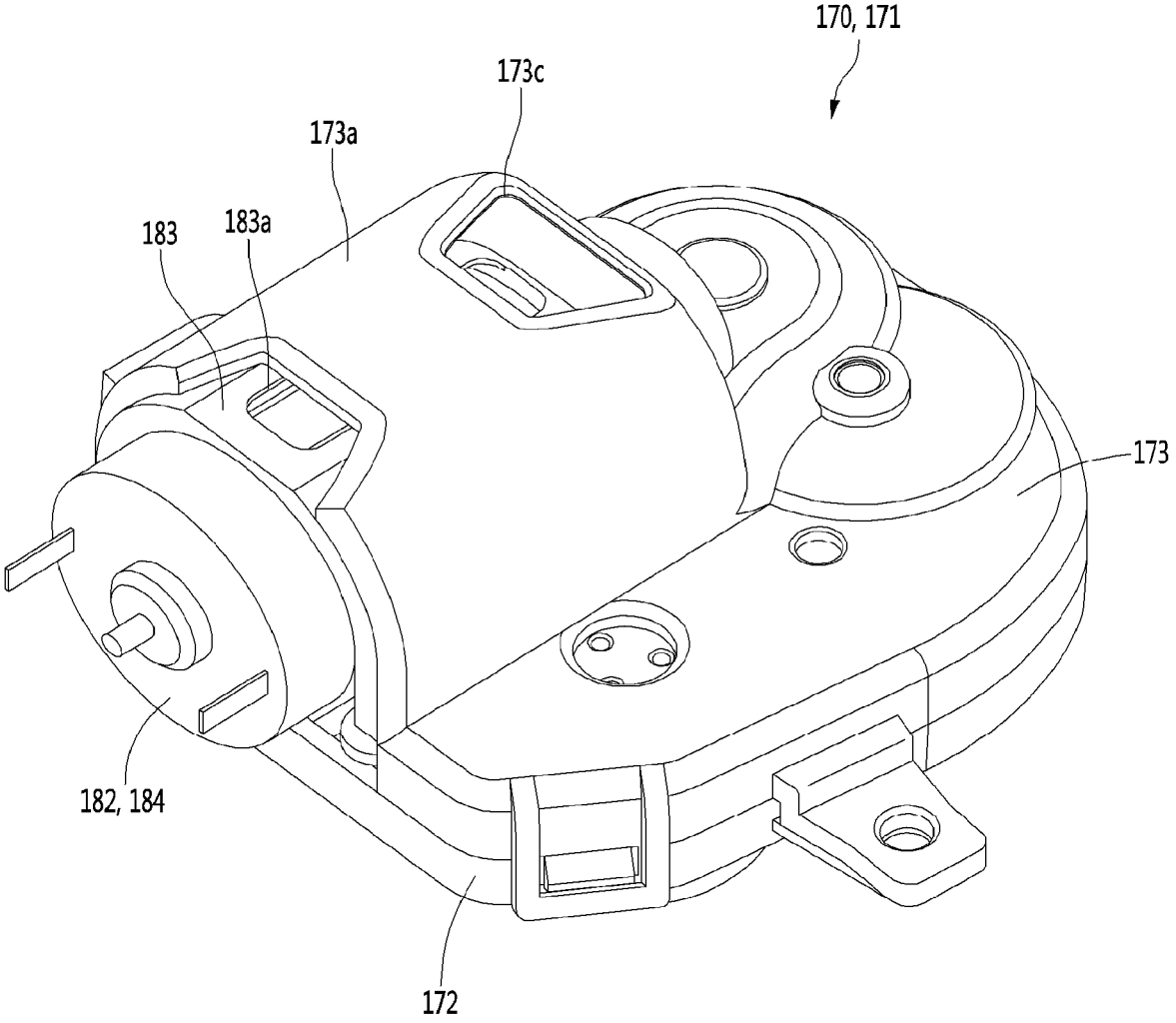
FIG. 16 is a view of first and second driving devices according to an embodiment of the present invention seen from above.
Figure 17:
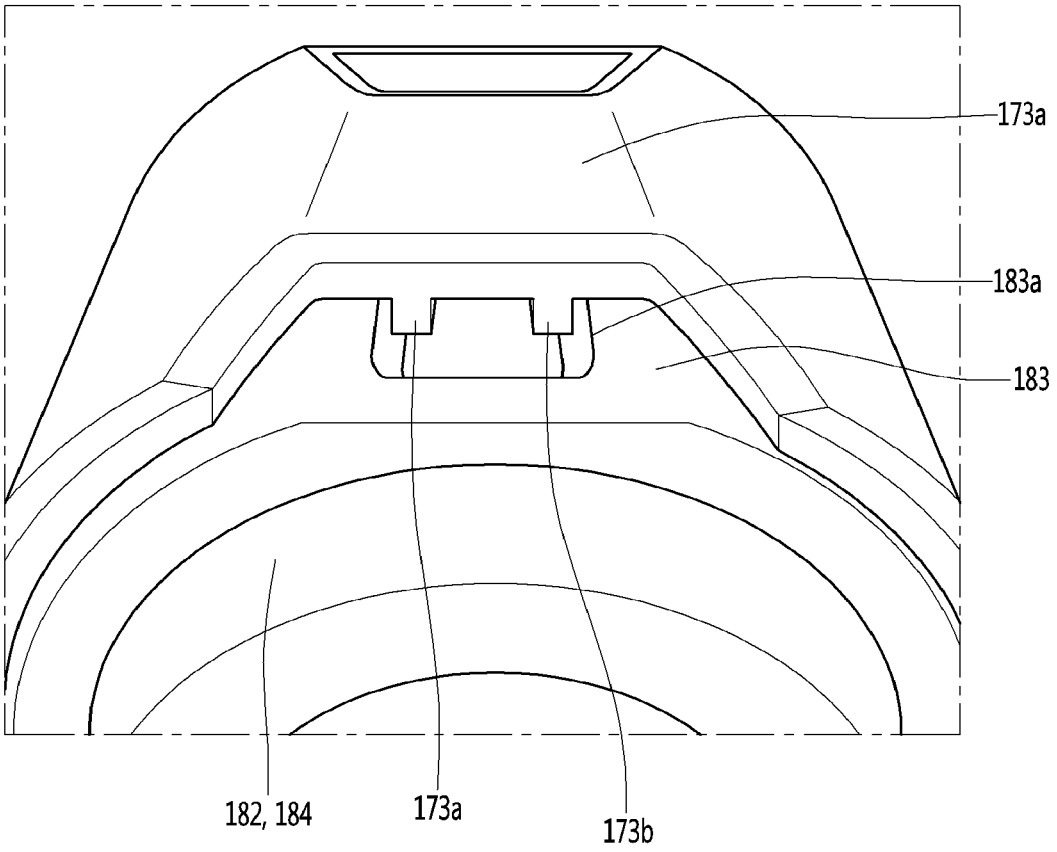
FIG. 17 is a view showing a motor housing and a structure for preventing rotation of a driving motor.
Figure 18:
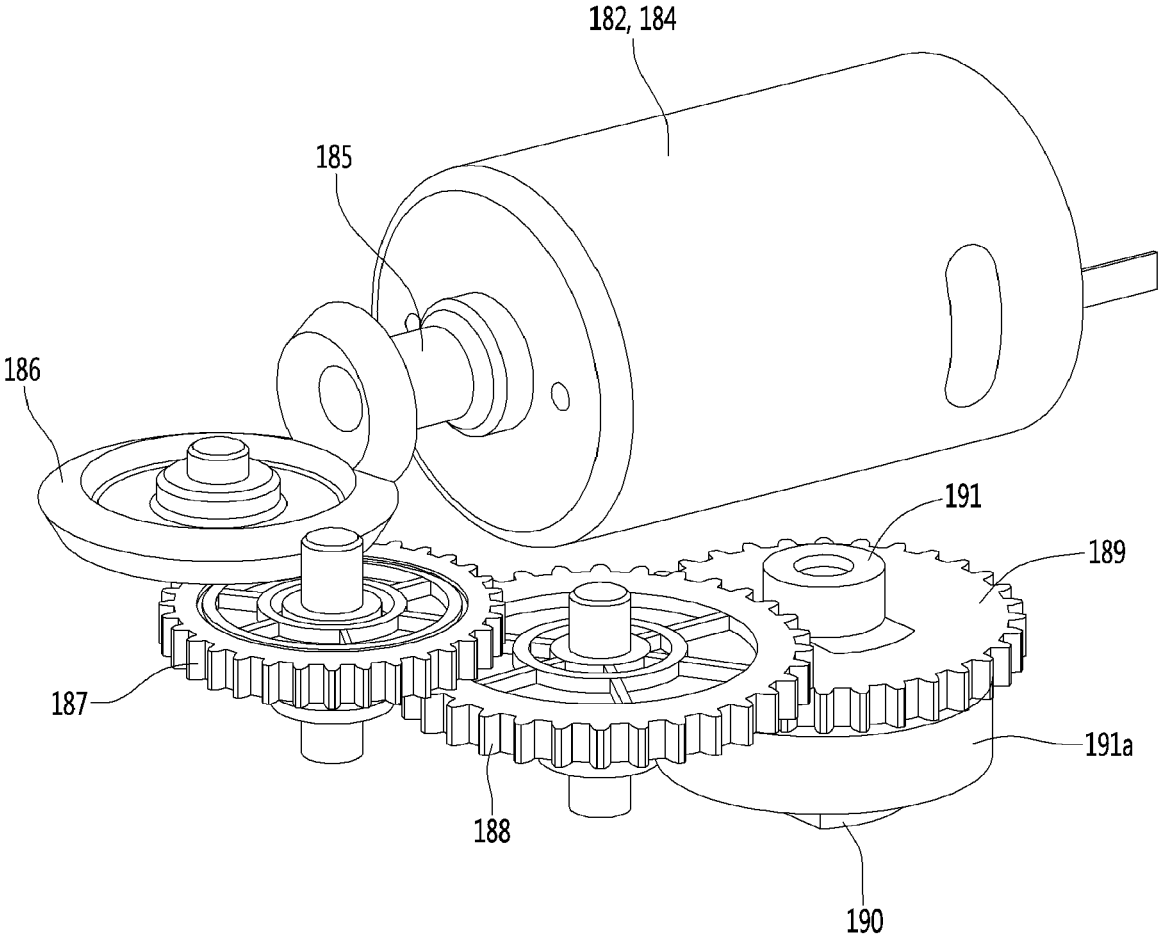
FIG. 18 is a view showing a state when a power transmission unit is combined with a driving motor according to an embodiment of the present invention.

FIG. 15 is a view illustrating the first and second driving devices according to one embodiment of the present invention as viewed from below, FIG. 16 is a view illustrating the first and second driving devices according to the embodiment of the present invention as viewed from above, FIG. 17 is a view illustrating a structure for preventing rotation of the motor housing and the driving motor, and FIG. 18 is a view illustrating a state where a power transmission unit is coupled to a driving motor according to an embodiment of the present invention.

Referring to FIG. 14 to FIG. 18, the first driving device 170 and the second driving device 171 may be formed and disposed symmetrically in the lateral direction.

The first driving device 170 may include a first driving motor 182 and the second driving device 171 may include a second driving motor 184.

A motor PCB 350 for driving each of the driving motors may be connected to the driving motors 182 and 184. The motor PCB 350 may be connected to the control board 115 to receive a control signal. The motor PCB 350 may be connected to the driving motors 182 and 184 in a standing state and may be spaced apart from the nozzle base 110.

A pair of resistors 352 and 354 for improving the Electro Magnetic Interference (EMI) performance of the driving motor may be disposed on the motor PCB 350.

One resistor of the pair of resistors 352 and 354 may be connected to the (+) terminal of the driving motor and the other resistor may be connected to the (−) terminal of the driving motor. Such a pair of resistors 352 and 354 can reduce the fluctuation of the output of the driving motor.

The pair of resistors 352 and 354 may be spaced laterally from the motor PCB 350, for example.

Each of the driving devices 170 and 171 may further include a motor housing. The driving motors 182 and 184 and a power transmission unit for transmitting power can be received in the motor housing.

The motor housing may include, for example, a first housing 172, and a second housing 173 coupled to the upper side of the first housing 172.

The axis of each of the driving motors 182 and 184 may extend in the horizontal direction in a state where each of the driving motors 182 and 184 is installed in the motor housing. If the driving devices are installed in the motor housing so that the axis of each of the driving motors 182 and 184 extends in the horizontal direction, the driving devices 170 and 171 can be compact.

The first housing 172 may have a shaft hole 175 through which the transmission shaft 190 for coupling with the rotation plates 420 and 440 of the power transmission unit passes. For example, a portion of the transmission shaft 190 may protrude downward through the lower side of the motor housing.

The horizontal section of the transmission shaft 190 may be formed in a non-circular shape such that relative rotation of the transmission shaft 190 is prevented in a state where the transmission shaft 190 is coupled with the rotation plates 420 and 440.

A sleeve 174 may be provided around the shaft hole 175 in the first housing 172. The sleeve 174 may protrude from the lower surfaces of the first housing 172.

The sleeve 174 may be formed in a ring shape, for example. Therefore, the sleeve 174 can be seated in the seating groove 116 in a circular shape.

The driving motors 182 and 184 may be seated on the first housing 172 and fixed to the first housing 172 by the motor fixing unit 183 in this state.

The driving motors 182 and 184 may be formed in a cylindrical shape and the driving motors 182 and 184 may be seated in the first housing 172 in a state where the axes of the driving motors 182 and 184 are horizontal (in a state where driving motors 182 and 184 are lying down).

The motor fixing unit 183 may be formed in an approximately semicircular shape in cross section and may cover the upper portion of the driving motors 182 and 184 seated on the first housing 172. The motor fixing unit 183 may be fixed to the first housing 172 by a fastening member such as a screw, as an example.

The second housing 173 may include a motor cover 173*a* covering a portion of the driving motors 182 and 184.

The motor cover 173*a* may be rounded so as to surround the motor fixing unit 183 from the outside of the motor fixing unit 183.

For example, the motor cover 173*a* may be formed in a round shape such that a portion of the second housing 173 protrudes upward.

In order to prevent relative rotation of the motor cover 173*a* and the motor fixing portion 183 while the driving motors 182 and 184 are operated, anti-rotation ribs 173*a* and 173*b* may be formed on the surface facing the motor fixing portion 183 of the motor cover 173*a*, and a rib receiving slot 183*a* in which the anti-rotation ribs 173*a* and 173*b* are received may be formed a the motor fixing portion 183.

Though not limited, the widths of the anti-rotation ribs 173*a* and 173*b* and the width of the rib receiving slot 183*a* may be the same.

Alternatively, the anti-rotation ribs 173*a* and 173*b* may be spaced in the circumferential direction of the driving motors 182 and 184 at the motor cover 173*a*, and the anti-rotation ribs 173*a* and 173*b* may be received in the rib receiving slot 183*a*.

The maximum width of the anti-rotation ribs 173*a* and 173*b* may be the same as or smaller than the rib receiving slot 183*a* in the circumferential direction of the driving motors 182 and 184.

The power transmission unit may include a driving gear 185 connected to the shaft of each of the driving motors 182 and 184 and a plurality of transmission gears 186, 187, 188, and 189 for transmitting the rotational force of the driving gear 185.

The axial lines A3 and A4 of the driving motors 182 and 184 horizontally extend, but the rotational center lines of the rotary plates 420 and 440 vertically extend. Accordingly, the driving gear 185, for example, may be a spiral bevel gear.

The plurality of transmission gears 186, 187, 188, and 189 may include a first transmission gear 186 that engages with the driving gear 185. The first transmission gear 186 may have a rotation center extending in a vertical direction.

The first transmission gear 186 may include a spiral bevel gear so that the first transmission gear 186 can engage with the driving gear 185.

The first transmission gear 186 may further include a helical gear disposed at a lower side of the spiral bevel gear as a second gear.

The plurality of transmission gears 186, 187, 188 and 189 may further include a second transmission gear 187 engaged with the first transmission gear 186.

The second transmission gear 187 may be a two-stage helical gear. That is, the second transmission gear includes two helical gears arranged up and down, and the upper helical gear may be connected with a helical gear of the second transmission gear 187. The plurality of transmission gears 186, 187, 188 and 189 may further include a third transmission gear 188 engaged with the second transmission gear 187.

The third transmission gear 188 may also be a two-stage helical gear. In other words, the third transmission gear 188 includes two helical gears arranged vertically, and the upper helical gear may be connected to the lower helical gear of the second transmission gear 187.

The plurality of transmission gears 186, 187, 188 and 189 may further include a fourth transmission gear 189 engaged with the lower helical gear of the third transmission gear 188. The fourth transmission gear 189 may be a helical gear.

The transmission shaft 190 may be coupled to the fourth transmission gear 189. The transmission shaft 190 may be coupled to penetrate the fourth transmission gear 189. The transmission shaft 190 may be rotated together with the fourth transmission gear 189.

Accordingly, an upper bearing 191 is coupled to the upper end of the transmission shaft 190 passing through the fourth transmission gear 189 and a lower bearing 191*a* is coupled to the transmission shaft 190 at the lower side of the fourth transmission gear 189.

Figure 19:
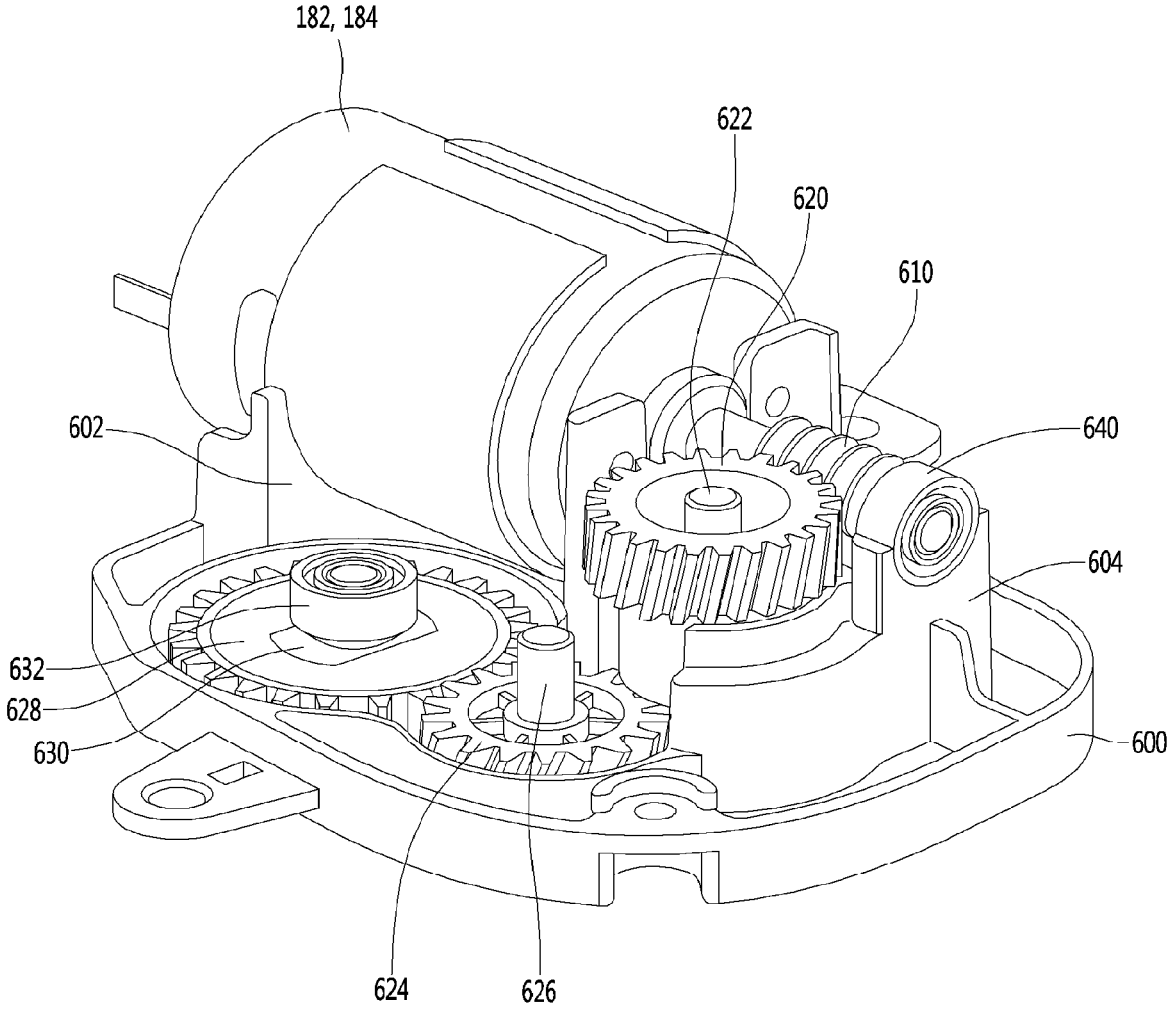
FIG. 19 is a view showing a state when a power transmission unit is combined with a driving motor according to another embodiment of the present invention.

FIG. 19 is a view illustrating a state where a power transmitting unit is coupled to a driving motor according to another embodiment of the present invention.

The present embodiment is the same as the previous embodiment in other portions but differs in the configuration of the power transmitting portion. Therefore, only the characteristic parts of the present embodiment will be described below.

Referring to FIG. 19, the power transmitting unit of the present embodiment may include a driving gear 610 connected to the shafts of the driving motors 182 and 184.

The driving gear 610 may be a worm gear. The rotational shaft of the driving gear 610 may extend in the horizontal direction. Since the driving gear 610 is rotated together with the rotating shaft of the driving gear 610, a bearing 640 may be connected to the driving gear 610 for smooth rotation.

A first housing 600 supporting the driving motors 184 and 814 may include a motor supporting portion 602 supporting the driving motors 182 and a bearing supporting portion 604 supporting the bearing 640.

The power transmission unit may further include a plurality of transmission gears 620, 624 and 628 for transmitting the rotational force of the driving gear 610 to the rotation plates 420 and 440.

The plurality of transmission gears 620, 624 and 628 may include a first transmission gear 620 engaged with the driving gear 610. The first transmission gear 620 may include an upper worm gear to engage with the driving gear 610.

Since the driving gear 610 and the second transmission gear 620 mesh with each other in the form of a worm gear, there is an advantage that noise is reduced by friction in a process in which the rotational force of the driving gear 610 is transmitted to the second transmission gear 620.

The first transmission gear 620 may include a helical gear disposed at the lower side of the upper worm gear as a second gear.

The first transmission gear 620 may be rotatably connected to a first shaft 622 extending in the vertical direction. The first shaft 622 may be fixed to the first housing 600.

Accordingly, the first transmission gear 620 can be rotated with respect to the fixed first shaft 622. According to the present embodiment, since the first transmission gear 620 is configured to rotate with respect to the first shaft 622, there is an advantage that a bearing is unnecessary.

The plurality of transmission gears 620, 624, and 628 may further include a second transmission gear 624 engaged with the first transmission gear 620. The second transmission gear 624 is, for example, a helical gear.

The second transmission gear 624 may be rotatably connected to a second shaft 626 extending in the vertical direction. The second shaft 626 may be fixed to the first housing 600.

Accordingly, the second transmission gear 624 can be rotated with respect to the fixed second shaft 626. According to the present embodiment, since the second transmission gear 624 is configured to rotate with respect to the second shaft 626, there is an advantage that no bearing is required.

The plurality of transmission gears 620, 624, and 628 may further include a third transmission gear 628 engaged with the second transmission gear 624. The third transmission gear 628 is, for example, a helical gear.

The third transmission gear 628 may be connected to a transmission shaft 630 connected to the rotation plates 420 and 440. The transmission shaft 630 may be connected to the third transmission gear 628 and rotated together with the third transmission gear 628.

A bearing 632 may be coupled to the transmission shaft 630 for smooth rotation of the transmission shaft 630.

<Disposition of Driving Device in Nozzle Base>

Figure 20:
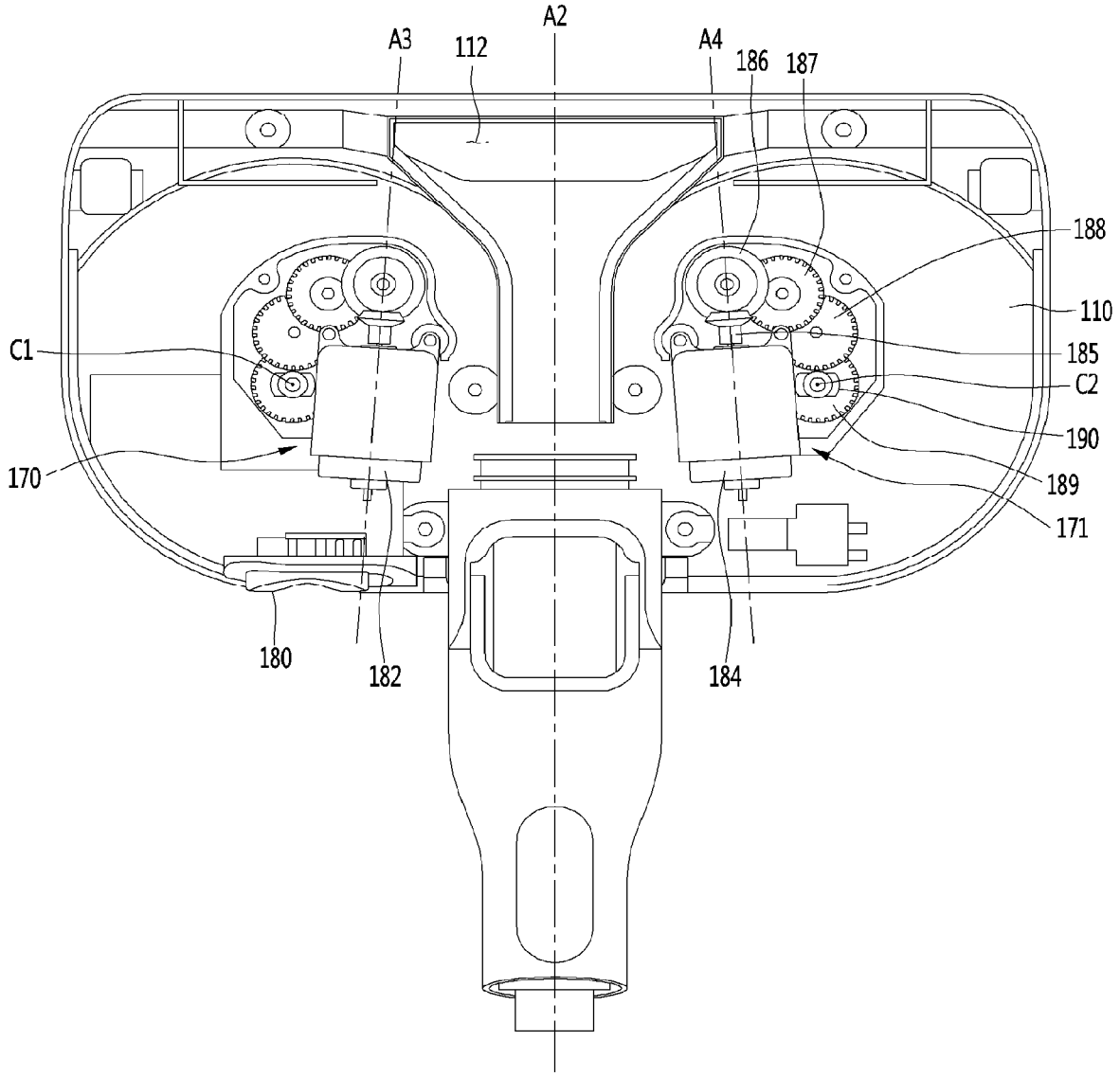
FIG. 20 is a plan view showing a state when a driving device is installed on a nozzle base according to an embodiment of the present invention.
Figure 21:
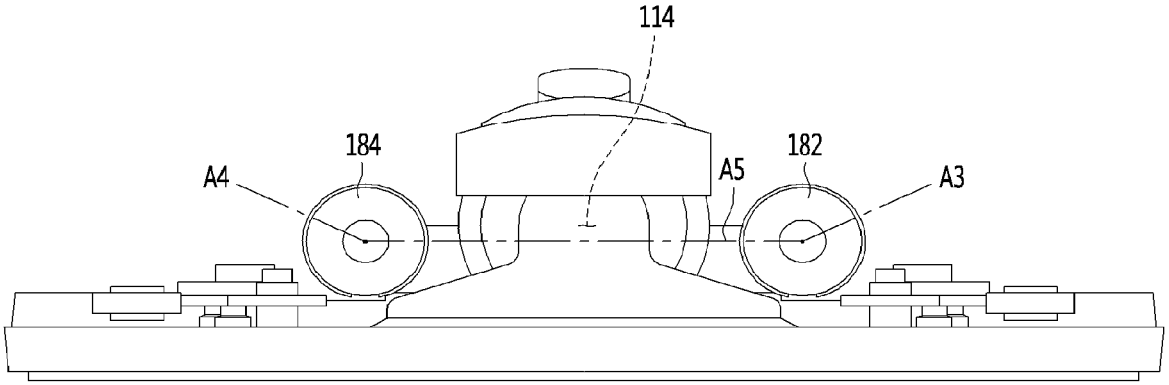
FIG. 21 is a front view showing a state when a driving device is installed on a nozzle base according to an embodiment of the present invention.

FIG. 20 is a plan view illustrating a state where a driving device is installed on a nozzle base according to an embodiment of the present invention, and FIG. 21 is a front view illustrating a state where a driving device is installed on a nozzle base according to an embodiment of the present invention.

Particularly, FIG. 20 illustrates a state where the second housing of the motor housing is removed.

Referring to FIG. 20 and FIG. 21, the driving devices 170 and 171 may be disposed on the nozzle base 110 so as to be spaced apart from each other in the lateral direction, as described above.

A centerline A2 of the second flow path 114 may be positioned between the first driving device 170 and the second driving device 171. By this disposition, the weight of each of the driving devices 170 and 171 can be evenly distributed to the right and left of the nozzle 1.

The axis A3 of the first driving motor 182 and the axis A4 of the second driving motor 184 may extend in the front and rear direction so that the height of the nozzle 1 is prevented from being increased by the driving motors 182.

The axis A3 of the first driving motor 182 and the axis A4 of the second driving motor 184 may be parallel or may be disposed at a predetermined angle.

In the present embodiment, the imaginary line A5 connecting the axis A3 of the first driving motor 182 and the axis A4 of the second driving motor 184 passes through the second flow path 114. This is because each of the driving motors 182 and 184 is positioned close to the rear side of the nozzle 1 so that the increase in the height of the nozzle 1 by the driving motors 182 and 184 can be prevented.

In addition, in a state where the driving gear 185 is connected to the shaft of each of the driving motors 182 and 184, so that the increase in the height of the nozzle 1 is minimized by each of the driving devices 170 and 171, the driving gear 185 may be positioned between the driving motors 182 and 184 and the first flow path 112.

In this case, since the driving motors 182 and 184 having the longest vertical length of the driving devices 170 and 171 are positioned as close as possible to the rear side in the nozzle main body 10, the increase in height of a side of the front end portion of the nozzle 1 can be minimized.

Since the driving devices 170 and 171 are positioned close to the rear side of the nozzle 1 and the water tank 200 is positioned above the driving devices 170 and 171, the center of gravity of the nozzle 1 may be pulled toward the rear side of the nozzle 1 due to the weight of the water in the water tank 200 and the driving devices 170 and 171.

Accordingly, in the present embodiment, the connection chamber (see 226 of FIG. 6) of the water tank 200 is positioned between the first flow path 112 and the driving devices 170 and 171 with respect to the front and rear directions of the nozzle 1.

Meanwhile, in the present embodiment, the rotation centers C1 and C2 of the rotation plates 420 and 440 coincide with the rotation center of the transmission shaft 190.

The axes A3 and A4 of the driving motors 182 and 184 can be positioned in the region between the rotation centers C1 and C2 of the rotation plates 420 and 440.

In addition, the driving motors 182 and 184 may be positioned in a region between the rotation centers C1 and C2 of the rotation plates 420 and 440.

In addition, each of the driving motors 182 and 184 may be disposed so as to overlap with the imaginary line connecting the first rotation center C1 and the second rotation center C2 in the vertical direction.

<Rotation Plate>

Figure 22:
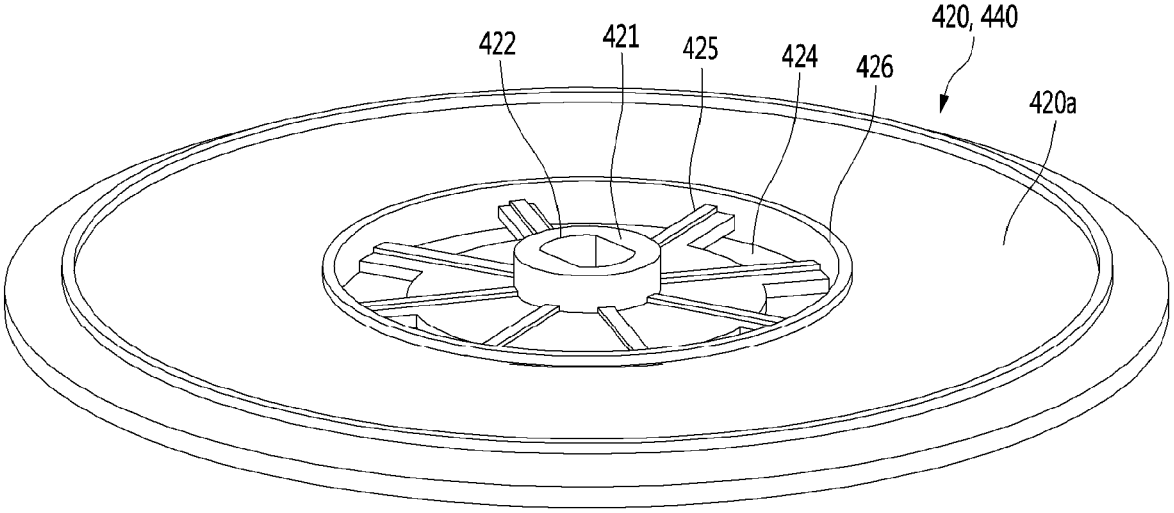
FIG. 22 is a view showing a rotary plate according to an embodiment seen from above.
Figure 23:
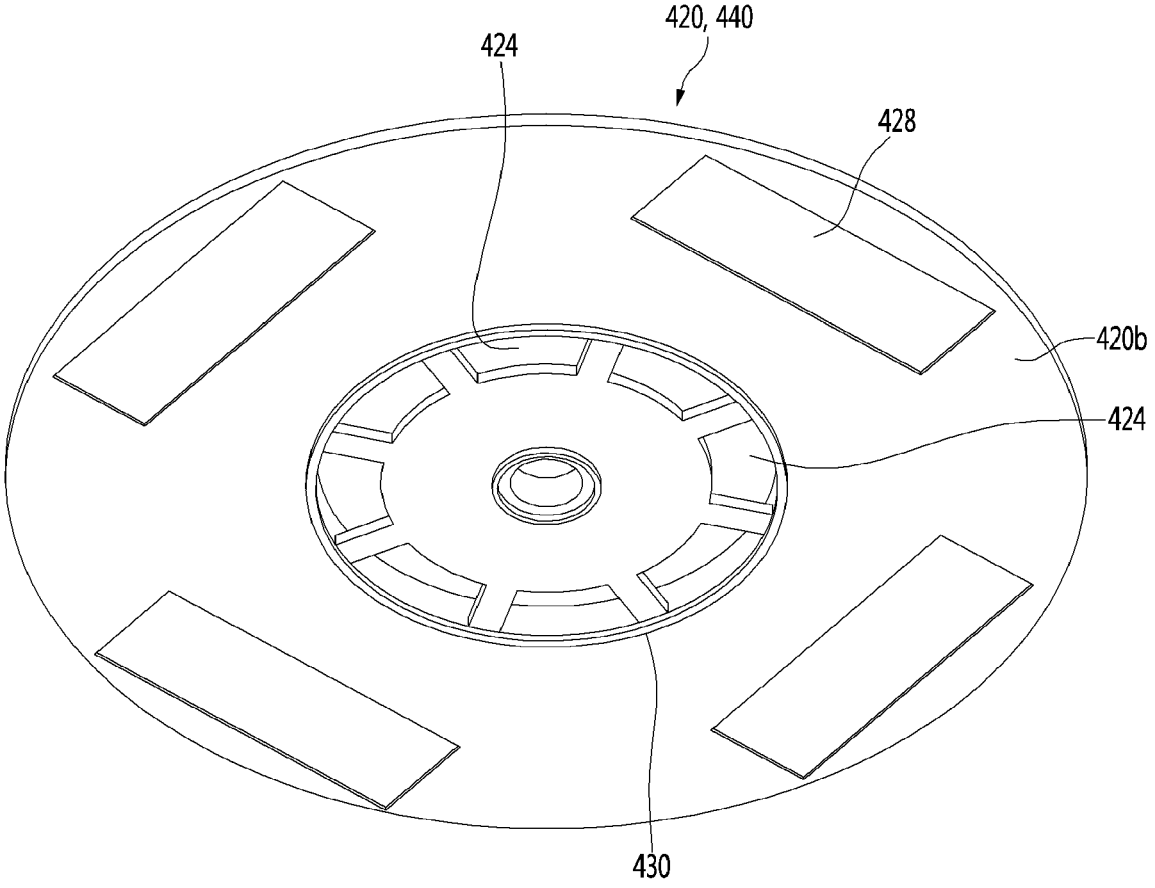
FIG. 23 is a view showing a rotary plate according to an embodiment seen from under.

FIG. 22 is a top view illustrating a rotation plate according to an embodiment of the present invention as viewed from above, and FIG. 23 is a bottom view illustrating a rotation plate according to an embodiment of the present invention as viewed from below.

Referring to FIG. 22 and FIG. 23, each of the rotation plates 420 and 440 may be formed in a disc shape so as to prevent mutual interference during the rotation process. A shaft coupling unit 421 for coupling the transmission shaft 190 may be provided at a central portion of each of the rotation plates 420 and 440.

For example, the transmission shaft 190 may be inserted into the shaft coupling unit 421. For this purpose, a shaft receiving groove 422 for inserting the transmission shaft 190 may be formed in the shaft coupling unit 421.

A fastening member may be drawn into the shaft coupling unit 421 from below the rotation plates 420 and 440 and be fastened to the transmission shaft 190 in a state where the transmission shaft 190 is coupled to the shaft coupling unit 421.

The rotation plates 420 and 440 may include a plurality of water passage holes 424 disposed outwardly of the shaft coupling unit 421 in the radial direction.

In the present embodiment, since the rotation plates 420 and 440 are rotated in a state where the mops 402 and 404 are attached to the lower sides of the rotation plates 420 and 440, so as to smoothly supply water to the mops 402 and 404 through the rotation plates 420 and 440, the plurality of water passage holes 424 may be spaced circumferentially around the shaft coupling unit 421.

The plurality of water passage holes 424 may be defined by a plurality of ribs 425. At this time, each of the ribs 425 may be positioned lower than the upper surface 420*a* of the rotation plates 420 and 440.

Since the rotation plates 420 and 440 rotate, centrifugal force acts on the rotation plates 420 and 440. It is necessary to prevent the water sprayed to the rotation plates 420 and 440 from flowing radially outward in a state where the water cannot pass through the water passage holes 424 in the rotation plates 420 and 440 due to the centrifugal force.

Therefore, a water blocking rib 426 may be formed on the upper surface 420*a* of the rotation plates 420 and 440 radially outside of the water passage hole 424. The water blocking ribs 426 may be formed continuously in the circumferential direction. In other words, the plurality of water passage holes 424 may be positioned in the inner region of the water blocking ribs 426. The water blocking ribs 426 may be formed in the form of a circular ring, for example.

An installation groove 428 may be formed on the lower surface 420*b* of the rotation plates 420 and 440 to provide attachment means for attaching the mops 402 and 404. The attachment means can be, for example, a Velcro.

A plurality of installation grooves 428 may be circumferentially spaced apart from each other with respect to the rotational centers C1 and C2 dust cloth plates 420 and 440. Accordingly, a plurality of attaching portions may be provided on the bottom 420*b* of the rotary plates 420 and 440.

In this embodiment, the installation grooves 428 may be disposed radially outside of the water passage hole 424 with respect to the rotational centers C1 and C2 of the rotation plates 420 and 440.

For example, the water passage hole 424 and the installation grooves 428 may be sequentially arranged radially outward from the rotational centers C1 and C2 of the rotation plates 420 and 440.

Contact ribs 430 that are brought into contact with the mops 402 and 404 attached to the attaching unit may be provided on the bottom 420*b* of the rotation plates 420 and 440.

The contact ribs 430 may protrude downward from the bottom 420*b* of the rotation plates 420 and 440.

The contact ribs 430 are disposed radially outward of the water passage holes 424 and may be formed continuously in the circumferential direction. For example, the contact rib 430 may be formed in a circular ring shape.

Since the mops 402 and 404 can be deformed by themselves, for example, as a fiber material, gaps can exist between the mops 402 and 404 and the lower surfaces 420*b* of the rotation plates 420 and 440 in a state where the mops 402 and 404 are attached to the rotation plates 420 and 440 by the attaching means.

When the gap existing between the mops 402 and 404 and the lower surfaces 420*b* of the rotation plates 420 and 440 is large, there is a fear that water will not be absorbed by the mops 402 and 404 in a state of passing through the water passage hole 424 and will flow outside through the gap between the lower surfaces 420*b* of the rotation plates 420 and 440 and the upper surface of the mops 402 and 404.

However, according to the present embodiment, when the mops 402 and 404 are coupled to the rotation plates 420 and 440, the contact ribs 430 can be brought into contact with the mops 402 and 404. When the nozzle 1 is placed on the floor, the contact ribs 430 press the mops 402, 404 by the load of the nozzle 1.

Accordingly, the contact ribs 430 prevent the formation of the gap between the lower surfaces 420*b* of the rotation plates 420 and 440 and the upper surfaces of the mops 402 and 404, and thus, water passing through the water passage holes 424 can be smoothly supplied to the mops 402 and 404.

<Water Supply Flow Path>

Figure 24:
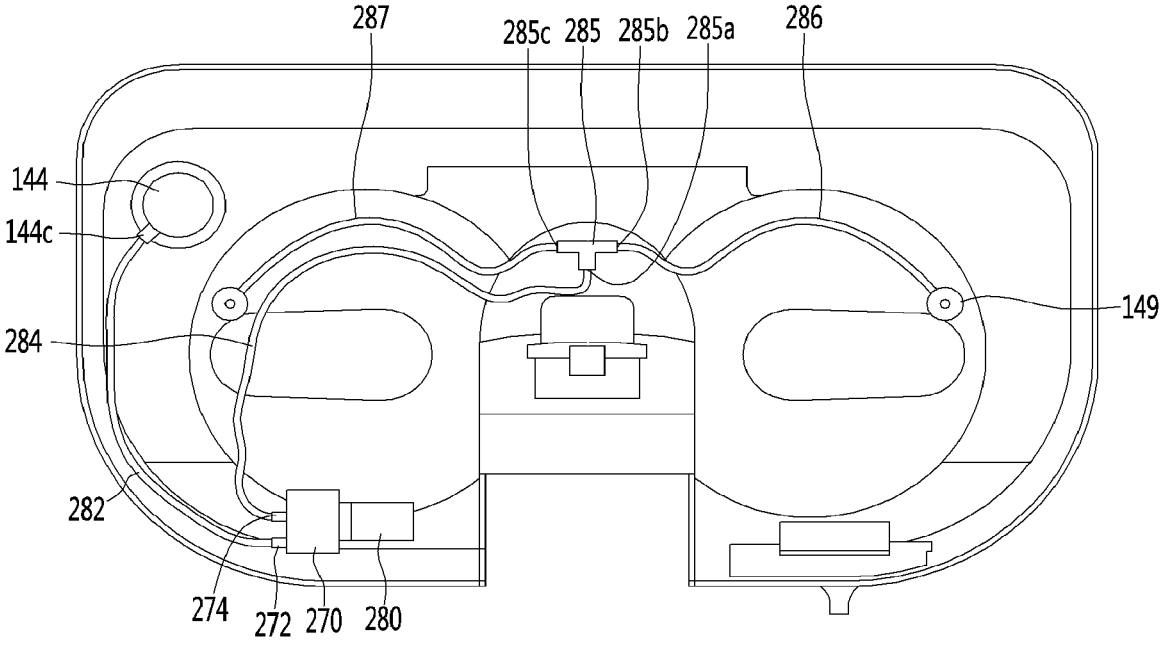
FIG. 24 is a view showing a water supply channel for supplying water in a water tank to a rotary cleaning unit according to an embodiment of the present invention.
Figure 25:
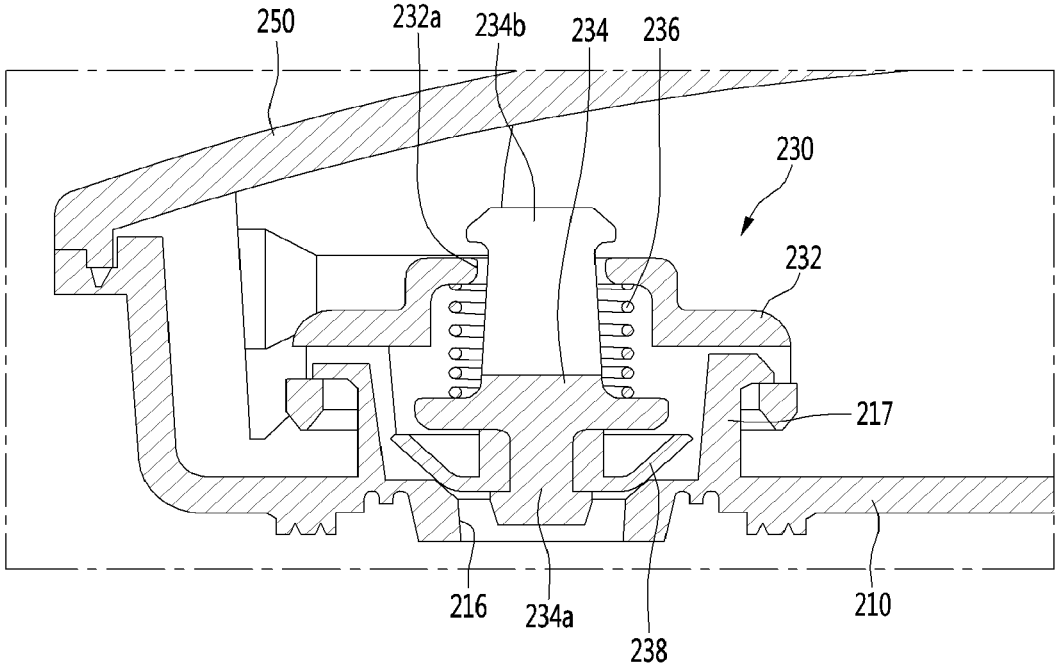
FIG. 25 is a view showing a valve in a water tank according to an embodiment of the preset invention.
Figure 26:
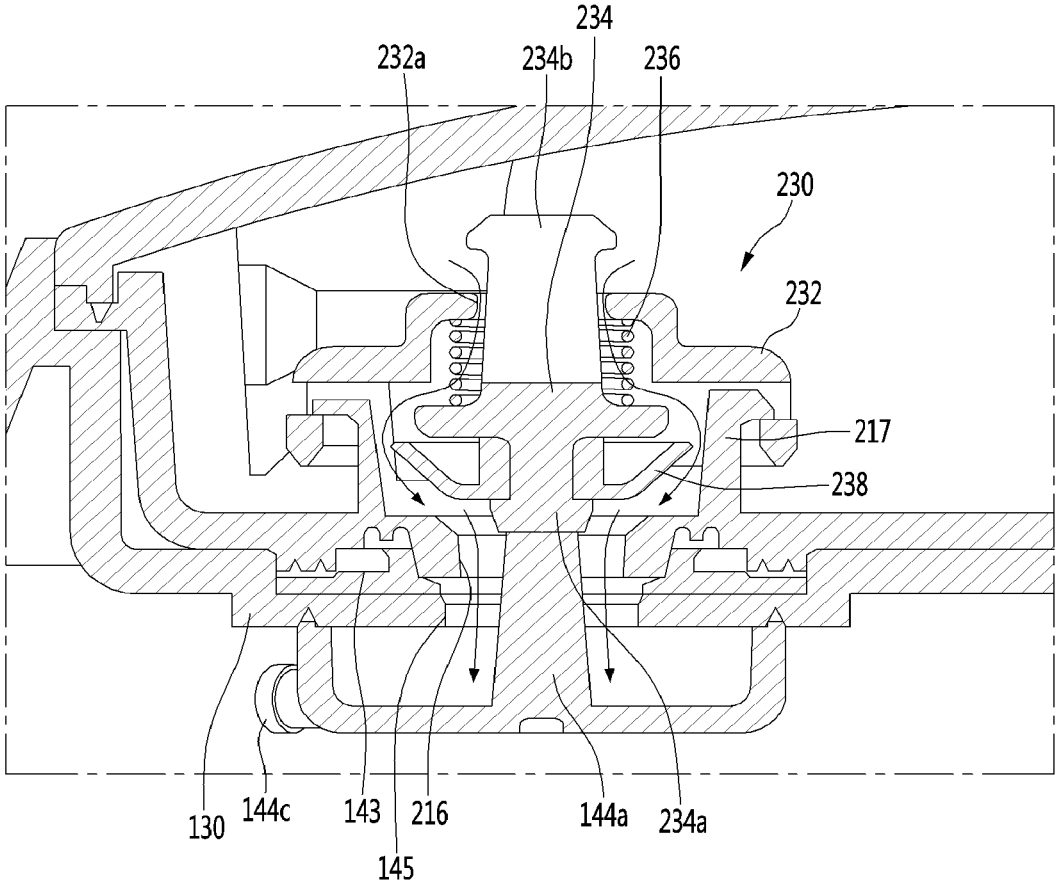
FIG. 26 is a view showing a state when an exhaust port of a valve is open with a water tank mounted on a nozzle housing.

FIG. 24 is a view illustrating a water supply flow path for supplying water of a water tank to the rotation cleaning unit according to an embodiment of the present invention, FIG. 25 is a view illustrating a valve in a water tank according to an embodiment of the present invention, and FIG. 26 is a view illustrating a state where the valve opens the discharge port in a state where the water tank is mounted on the nozzle housing.

Figure 27:
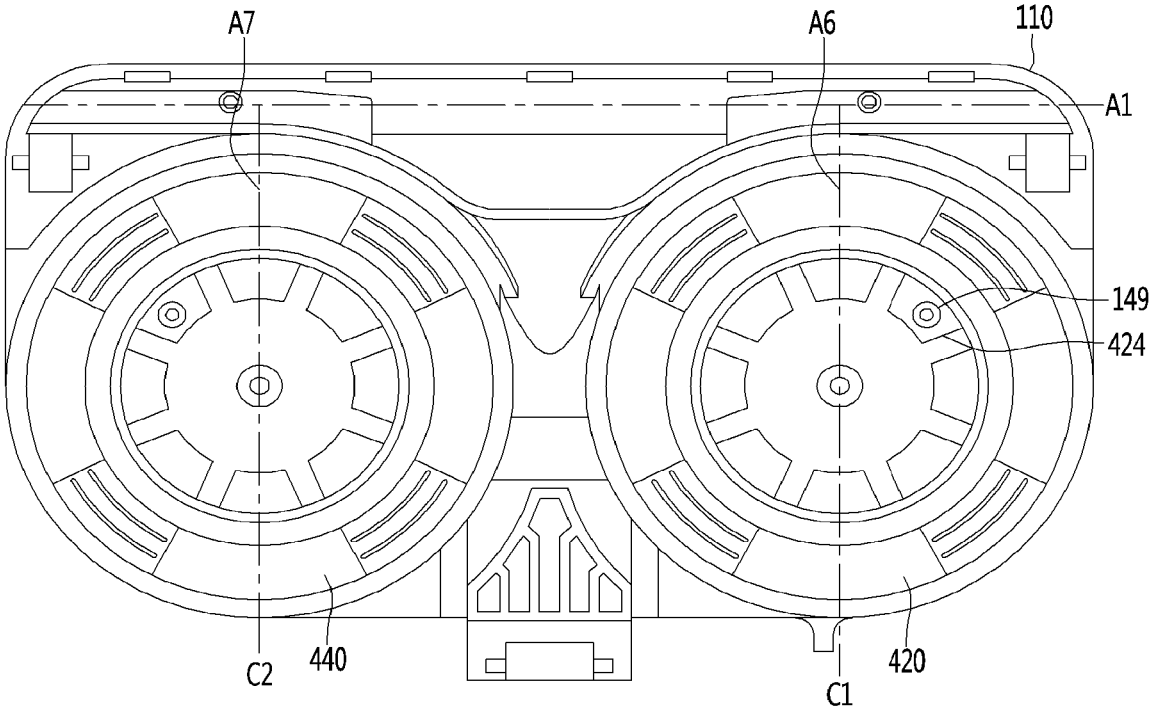
FIG. 27 is a view showing a state when a rotary plate is combined with a nozzle main body according to an embodiment of the present invention.
Figure 28:
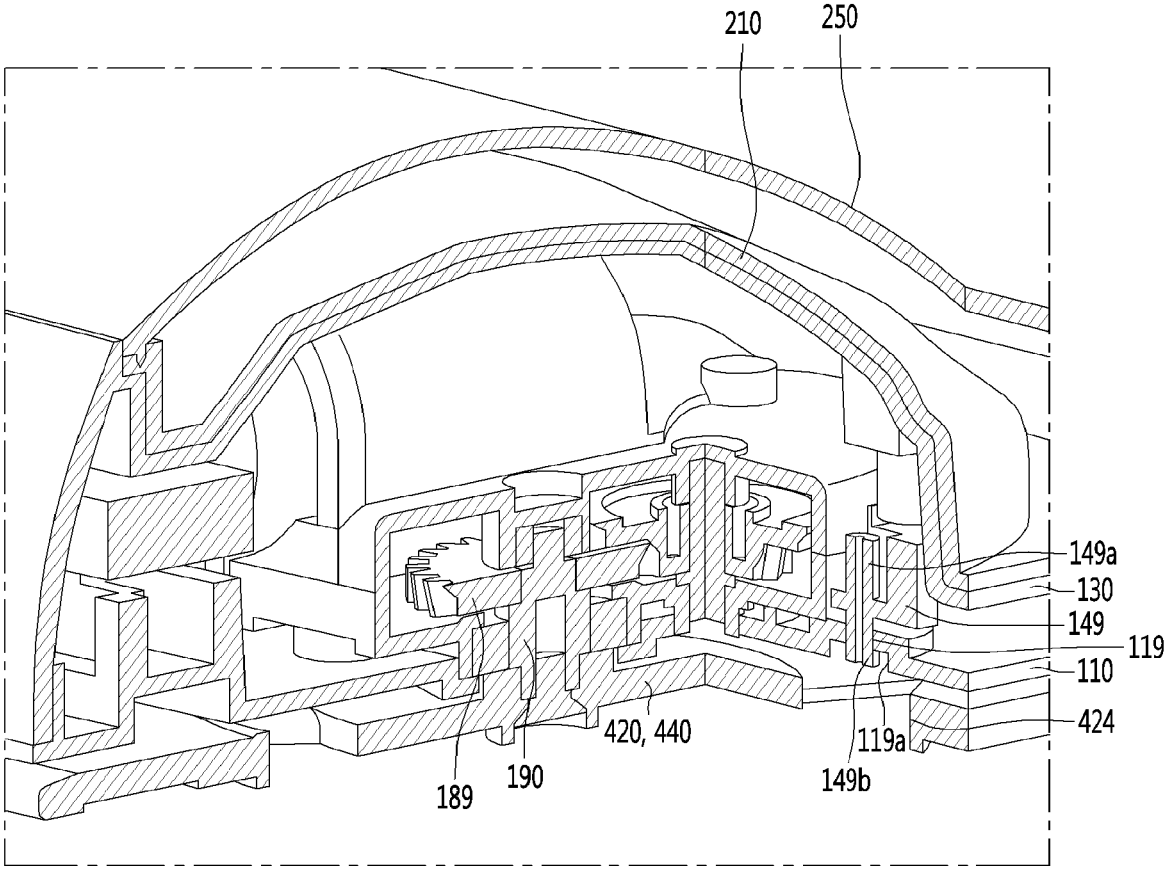
FIG. 28 is a view showing arrangement of a spray nozzle on a nozzle main body according to an embodiment of the present invention.

FIG. 27 is a view illustrating a state where a rotation plate according to an embodiment of the present invention is coupled to a nozzle main body and FIG. 28 is a view illustrating a disposition of a spray nozzle in a nozzle main body according to an embodiment of the present invention.

Figure 29:
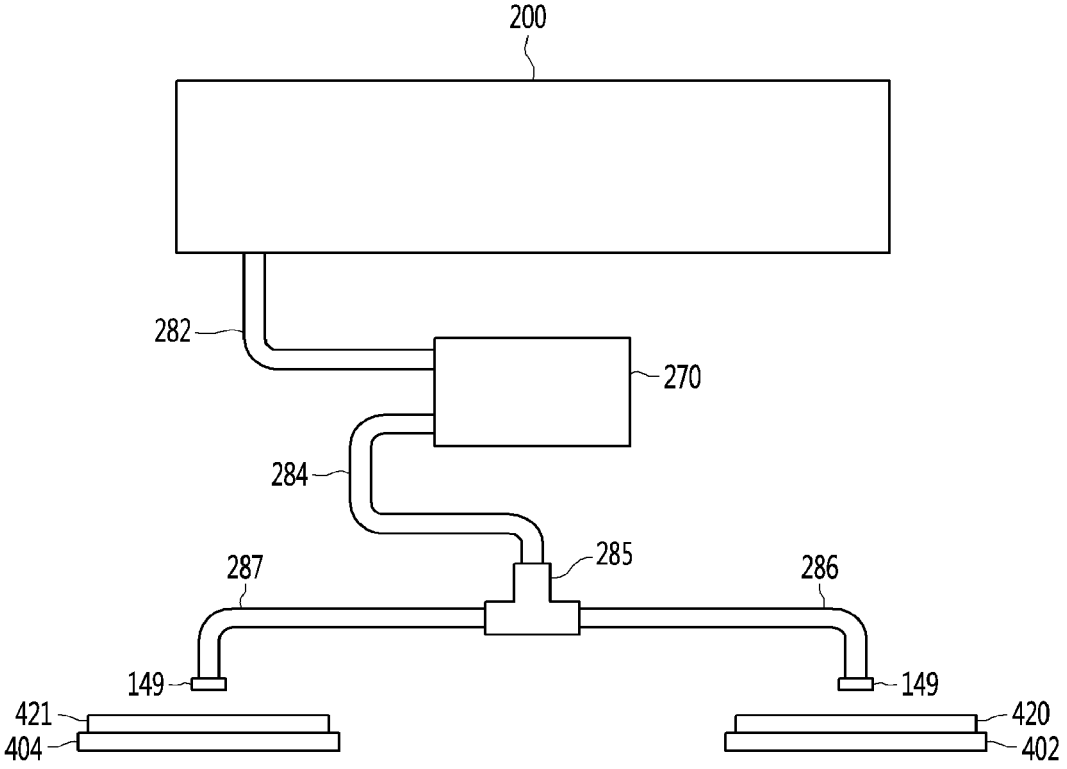
FIG. 29 is a conceptual view showing a process of supplying water from a water tank to a rotary cleaning unit according to an embodiment of the present invention.

FIG. 29 is a conceptual diagram illustrating a process of supplying water to a rotation cleaning unit in a water tank according to an embodiment of the present invention.

Referring to FIG. 24 to FIG. 29, the water supply flow path of the present embodiment includes a first supply tube 282 connected to the valve operating unit 144, a water pump 270 connected to the first supply tube 282, and a second supply tube 284 connected to the water pump 270.

The water pump 270 may include a first connection port 272 to which the first supply tube 282 is connected and a second connection port 274 to which the second supply tube 284 is connected. On the basis of the water pump 270, the first connection port 272 is an inlet, and the second connection port 274 is a discharge port.

In addition, the water supply flow path may further include a connector 285 to which the second supply tube 284 is connected.

The connector 285 may be formed such that the first connection unit 285*a*, the second connection unit 285*b*, and the third connection unit 285*c* are arranged in a T-shape. The second supply tube 284 may be connected to the first connection unit 285*a*.

The water supply flow path may further include a first branch tube 286 connected to the second connection unit 285*b* and a second branch tube 287 connected to the third connection unit 285*c*.

Accordingly, the water flowing through the first branch tube 286 may be supplied to the first rotation cleaning unit 40 and may be supplied to the second rotation cleaning unit 41 flowing through the second branch tube 287.

The connector 285 may be positioned at the center portion of the nozzle main body 10 such that each of the first and second branch tubes 286 and 287 has the same length.

For example, the connector 285 may be positioned below the flow path cover 136 and above the flow path forming portion 150. In other words, the connector 285 may be positioned directly above the second flow path 114. Thus, substantially the same amount of water can be dispensed from the connector 285 to each of the first and second branch tubes 286 and 287.

In the present embodiment, the water pump 270 may be positioned at one point on the water supply flow path.

At this time, the water pump 270 may be positioned between the valve operating unit 144 and the first connection unit 285*a* of the connector 285 so that water can be discharged from the water tank 200 using a minimum number of the water pumps 270.

In the present embodiment, the water pump 270 may be installed in the nozzle cover 130 in a state where the water pump 270 is positioned close to the portion where the valve operating unit 144 is installed.

As an example, the valve operating unit 144 and the water pump 270 may be provided on one side of both sides of the nozzle main body 10 with respect to the centerline A2 of the second flow path 114.

Therefore, the length of the first supply tube 282 can be reduced, and accordingly, the length of the water supply flow path can be reduced.

A diverging pipe may be connected with the spray nozzle 149. The spray nozzle 149 also forms a water supply channel of the present invention.

The spray nozzle 149, as described above, may include a connecting portion 149*a* for connection with the diverging pipe.

The spray nozzle 149 may further include a nozzle end portion 149*b*. The nozzle end portion 149*b* extends downward through the nozzle hole 119. In other words, the nozzle end portion 149*b* may be disposed on the outside of the nozzle housing 100.

When the nozzle end portion 149*b* is positioned outside the nozzle housing 100, water sprayed through the nozzle end portion 149*b* can be prevented from being drawn into the nozzle housing 100.

At this time, so as to prevent the nozzle end portion 149*b* exposed to the outside of the nozzle housing 100 from being damaged, groove 119*a* recessed upward is formed in the bottom of the nozzle base 110. The nozzle end portion 149*b* may be positioned in the groove 119*a* in a state of passing through the nozzle hole 119. In other words, the nozzle hole 119 may be formed in the groove 119*a*.

Further, the nozzle end 149*a* may be disposed in the groove 119*a* to face the rotation plates 420 and 440.

Accordingly, the water sprayed from the nozzle end 149*a* can pass through the nozzle passage hole 424 of the rotation plates 420 and 440.

A line perpendicularly connecting the first rotation center C1 and the centerline A1 of the first flow path 112 may be referred to as a first connection line A6, and a line perpendicularly connecting the second rotation center C2 and an axis A1 of the first flow path 112 may be referred to as a second connecting line A7.

At this time, the first connection line A6 and the second connection line A7 may be positioned in a region between a pair of spray nozzles 149 for supplying water to each of the rotation cleaning units 40 and 41.

This is because the spray nozzle 149 is disposed to prevent interference with these parts, since the components constituting the driving devices 170 and 171 exist in the area between the first connection line A6 and the second connection line A7.

In addition, the horizontal distance between the spray nozzle 149 and the centerline A1 of the first flow path 112 is shorter than the horizontal distance between each of the rotation centers C1 and C2 and the centerline A1 of the first flow path 112.

Meanwhile, the valve 230 may include a movable unit 234, an opening and closing unit 238, and a fixing unit 232.

The fixing unit 232 may be fixed to a fixing rib 217 protruding upward from the first body 210 of the water tank 200.

The fixing unit 232 may have an opening 232*a* through which the movable unit 234 passes.

The fixing unit 232 restricts the movable unit 234 from moving upward at a predetermined height from the fixing unit 232 in a state where the fixing unit 232 is coupled with the fixing rib 217.

The movable unit 234 can be moved in the vertical direction in a state where a portion of the movable unit 234 passes through the opening 232*a*. In a state where the movable unit 234 is moved upward, water can pass through the opening 232*a*.

The movable unit 234 may include a first extension portion 234*a* extending downward and coupled with the opening and closing unit 238 and a second extension portion 234*b* extending upwardly and passing through the opening 232*a*.

The movable unit 234 may be elastically supported by an elastic member 236. One end of the elastic member 263, as a coil spring, for example, may be supported by the fixed portion 232 and the other end may be supported by the movable unit 234.

The elastic member 236 provides a force to the movable unit 234 to move the movable unit 234 downward.

The opening/closing unit 238 can selectively open the discharge port 216 by moving the movable unit 234 up and down.

At least a portion of the opening/closing unit 238 may have a diameter larger than the diameter of the discharge port 216 so that the opening/closing unit 238 may block the discharge port 216.

The opening/closing unit 238 may be formed of, for example, a rubber material so that the leakage of water is prevented in a state where the opening/closing unit 238 blocks the discharge port 216.

The elastic force of the elastic member 236 is applied to the movable unit 234 so that a state where the opening and closing unit 238 blocks the discharge port 216 can be maintained unless an external force is applied to the movable unit 234.

The movable unit 234 can be moved by the valve operating unit 144 in the process of mounting the water tank 200 to the nozzle main body 10.

The valve operating unit 144 is coupled to the nozzle cover 130 from below the nozzle cover 130 as described above. A water passage opening 145 through which the water discharged from the water tank 200 passes may be formed in the nozzle cover 130.

The valve operating unit 144 may include a pressing portion 144*a* passing through the water passage opening 145. The pressing portion 144*a* may protrude upward from the bottom of the nozzle cover 130 in a state of passing through the water passage opening 145 of the nozzle cover 130.

The valve operating unit 144 may form a water supply flow path together with the bottom of the nozzle cover 130. A connection tube 144*c* for connecting the first supply tube 282 may be provided at one side of the valve operating unit 144.

The diameter of the water passage opening 145 may be larger than the outer diameter of the pressing portion 144*a* so that water flows smoothly in a state where the pressing portion 144*a* passes through the water passage opening 145.

When the water tank 200 is mounted on the nozzle main body 10, the pressing portion 144*a* is drawn into the discharge port 216 of the water tank 200. The pressing portion 144*a* presses the movable unit 234 in a process in which the pressing portion 144*a* is being drawn into the discharge port 216 of the water tank 200.

The movable unit 234 is lifted and the opening and closing unit 238 coupled to the movable unit 234 moves upward together with the movable unit 234 to be separated from the discharge port 216 to open the discharge port 216.

The water in the water tank 200 is discharged through the discharge port 216, flows along the valve operating unit 144 through the water passage opening 145 and then is supplied to the first supply tube 282 connected to the connection tube 144*c*.

The water supplied to the first supply tube 282 flows into the second supply tube 284 after being drawn into the water pump 270. The water flowing into the second supply tube 284 flows to the first branch tube 286 and the second branch tube 287 by the connector 285. The water flowing into each of the first and second branch tubes 286 and 287 is sprayed from the spray nozzle 149 toward the rotation cleaning units 40 and 41.

The water sprayed from the spray nozzle 149 is supplied to the mops 402 and 404 after passing through the water passage holes 424 of the rotation plates 420 and 440. The mops 402 and 404 are rotated while absorbing the supplied water to wipe the floor.

Figure 30:
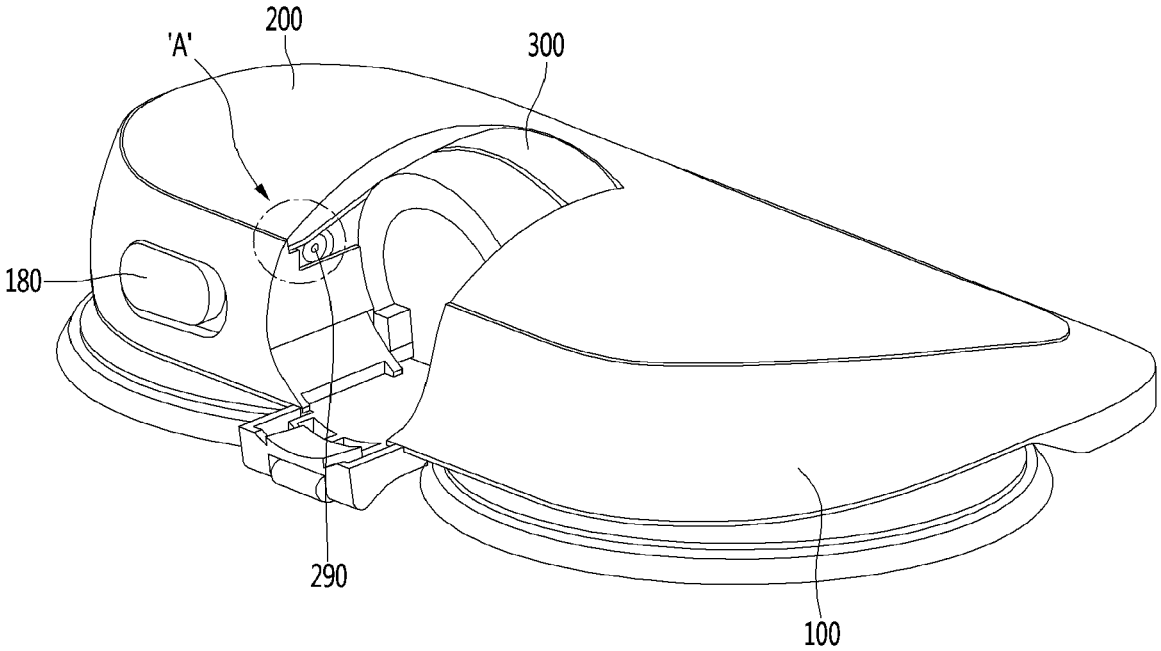
FIG. 30 is a perspective view of a nozzle for a cleaner with a connection pipe separated, seen from the rear.
Figure 31:
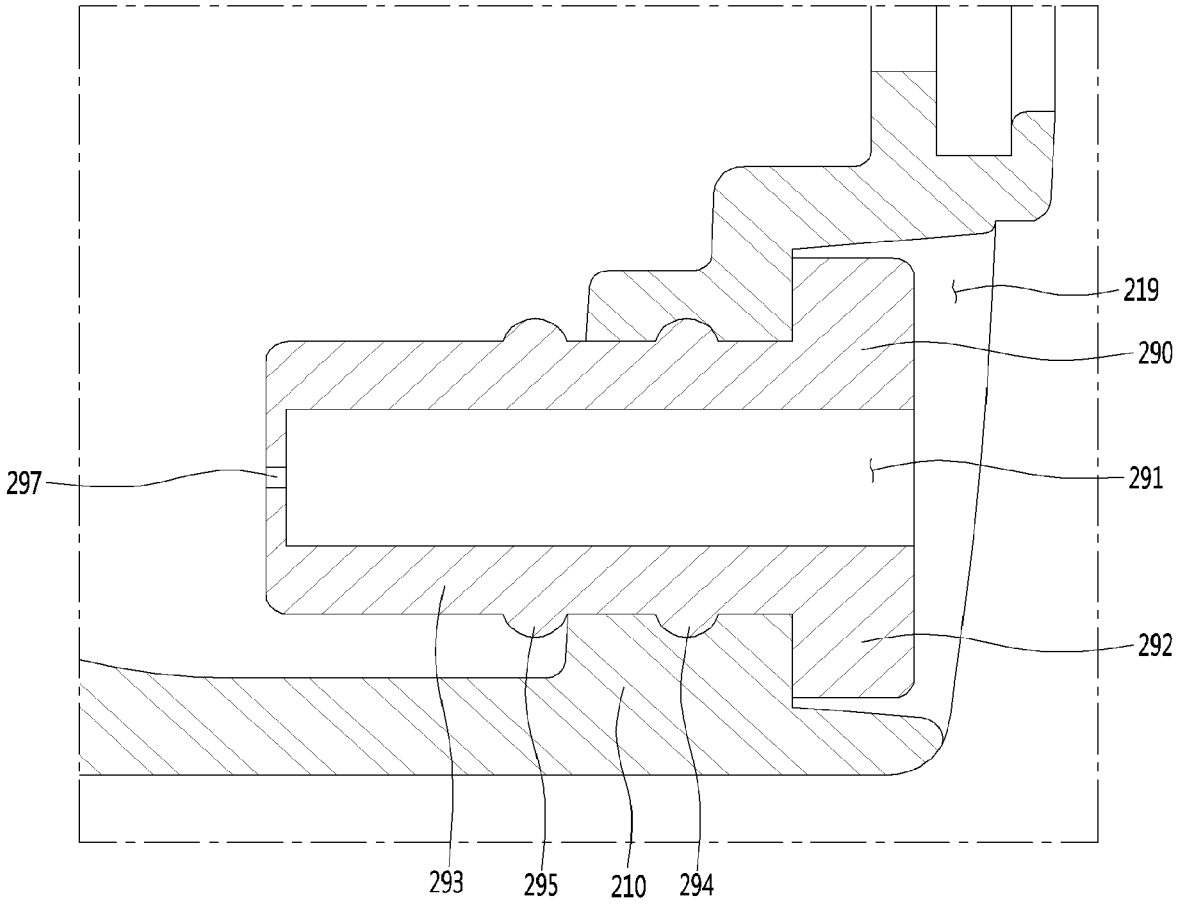
FIG. 31 is a cross-sectional view of an area of FIG. 30.
Figure 32:
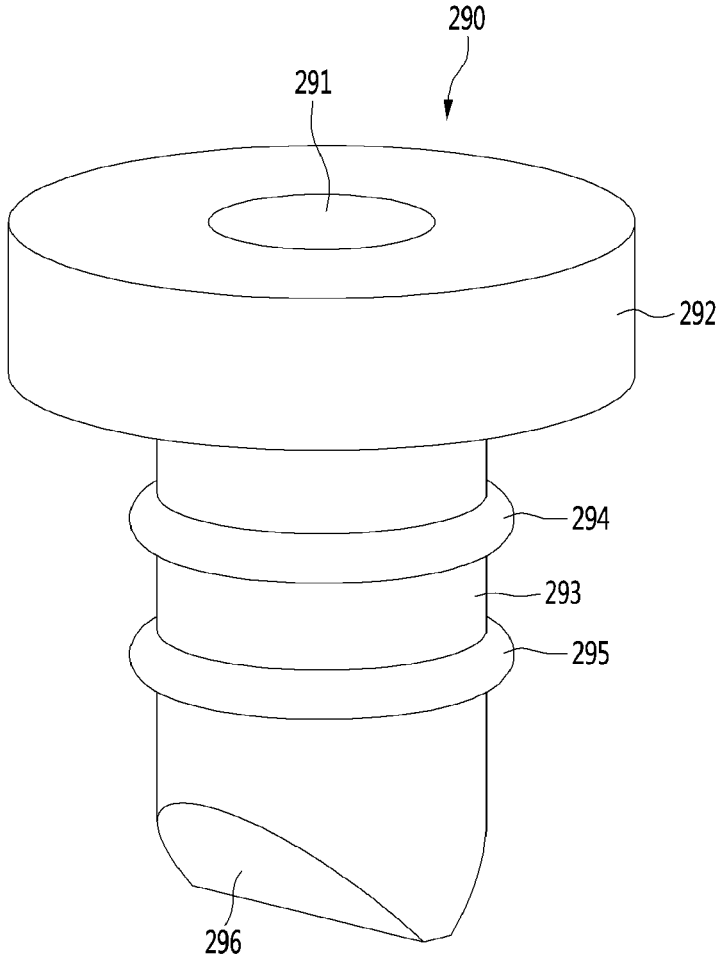
FIG. 32 is a perspective view showing mainly a cap of FIG. 31.

FIG. 30 is a perspective view illustrating the nozzle for the cleaner from which a connection tube is separated according to an embodiment of the present invention as viewed from the rear side, FIG. 31 is a sectional view illustrating area in FIG. 30, and FIG. 32 is a perspective view illustrating the gasket of FIG. 31.

Referring to FIG. 30 to FIG. 32, at least one air hole 219 for introducing outside air may be formed in the water tank 200. Hereinafter, as an example, one air hole 219 is formed in the water tank 200, but a plurality of the air holes 219 may be provided.

The air holes 219 may be formed on one side of the water tank 200.

In detail, the gasket 290 may be press-fitted into the air hole 219.

The gasket 290 can guide the outside air into the interior space of the water tank 200.

The gasket 290 may be referred to as a check valve in that the outside air flows into the water tank 200 while the water in the water tank 200 is interrupted so as not to be discharged to the outside.

The gasket 290 may be formed of a material deformed in shape by an external force. For example, the gasket 290 may be formed of polyethylene material but is not limited thereto.

The gasket 290 may include a cylindrical body 293, for example.

An end portion of one side of the body 293 may be received inside the water tank 200 through the air hole 219. The other end portion of the body 293 may be exposed to the outside of the water tank 200.

At least one sealing protrusion 294 and 295 may be formed on the outside of the body 293. The outer diameter of the sealing protrusions 294 and 295 may be larger than the inner diameter of the air hole 219. When the sealing protrusions 294 and 295 are formed as described above, leakage between the body 293 and the air holes 219 can be prevented.

In a case where a plurality of the sealing protrusions 294 and 295 are formed, a portion of the sealing protrusions 294 and 295 may be positioned inside the water tank 200.

A flange 292 having an outer diameter larger than that of the body 293 and the sealing protrusions 294 and 295 may be formed at the other end portion of the body 293. The flange 292 has a larger diameter than the air hole 219. The entirety of the gasket 290 is prevented from entering the inside of the water tank 200 by the flange 292.

Further, the gasket 290 may have an air channel 291 at the center through which air flows, and may have a slit 297 formed by cutting the other end thereof. The other end of the gasket 290 may be come in contact with the water in the water tank 200.

In addition, so that the slit 297 formed at the other end portion of the gasket 290 is blocked by the pressure of water, the gasket 290 is formed such that the sectional area of the gasket 290 decreases from one point to the other end portion, and thus inclined surfaces 296 can be formed on the outer side.

In detail, the inclined surfaces 296 may be formed on both sides of the slit 297.

According to an embodiment, the water pressure is applied to the inclined surface 296 formed at the other end portion of the gasket 290 and thus the other end portion of the gasket 290 inwardly shrinks, and in this process, the slit 297 is blocked in a state where the inner pressure of the water tank 200 is not lowered (a state where water is not discharged).

Therefore, water in the water tank 200 is prevented from leaking to the outside through the slit 297.

In addition, the slit 297 is blocked by the water pressure of the water tank 200 so that the air is not supplied to the inner portion of the water tank 200 through the slit 297 in a state where no external force is applied to the gasket 290.

Meanwhile, outside air can be supplied to the water tank 200 through the gasket 290 in a state where the internal pressure of the water tank 200 is lowered (a state where water is discharged).

Specifically, when the pump motor 280 operates, the water in the water tank 200 is discharged through the discharge port 216 by the water pump 270. Then, the internal pressure of the water tank 200 is instantaneously lowered.

In addition, while the pressure applied to the inclined surface 296 of the gasket 290 is also lowered, the other end portion of the gasket 290 is restored to an original state thereof, and the slit 297 can be opened.

As described above, when the slit 297 is opened, the outside air can be supplied to the water tank 200 through the slit 297.

In a state where the slit 297 is opened, the surface tension of the water around the slit 297 and the force with which the external air flows are greater than the water pressure in the water tank 200, and water is not discharged to the outside of the water tank 200 through the slit 297.

According to the present embodiment, water in the water tank 200 can be prevented from being discharged to the outside through the gasket 290 when the water pump 270 is not operated.

In addition, in a state where the water pump 270 is operated, since air can be introduced into the water tank 200 through the slits 297 of the gasket 290, the water in the water tank 200 can be stably supplied to the mops 402 and 404.

Figure 33:
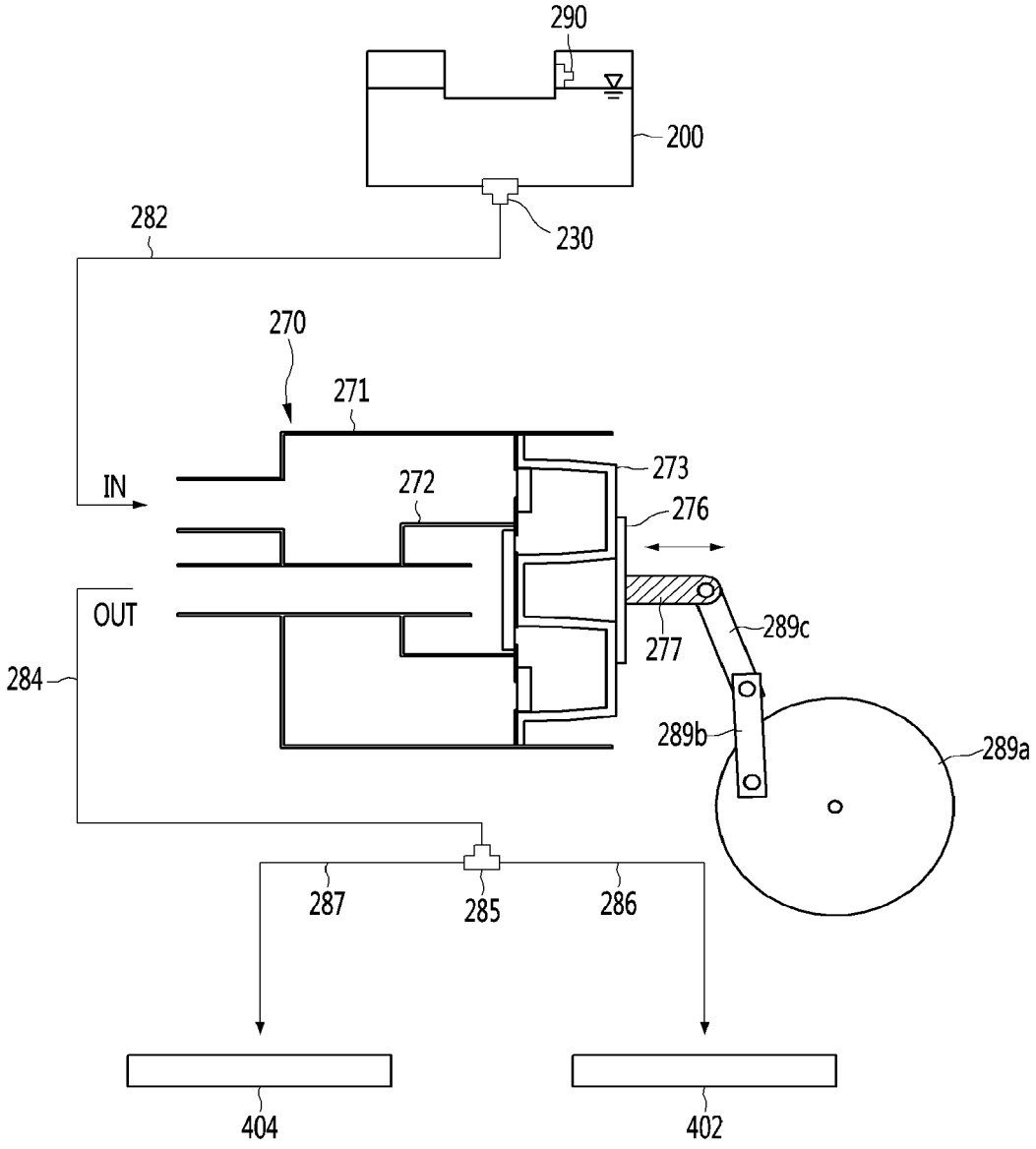
FIG. 33 is a view schematically showing the configuration of a water supply channel and a water pump that is a component of the present invention.
Figure 34:
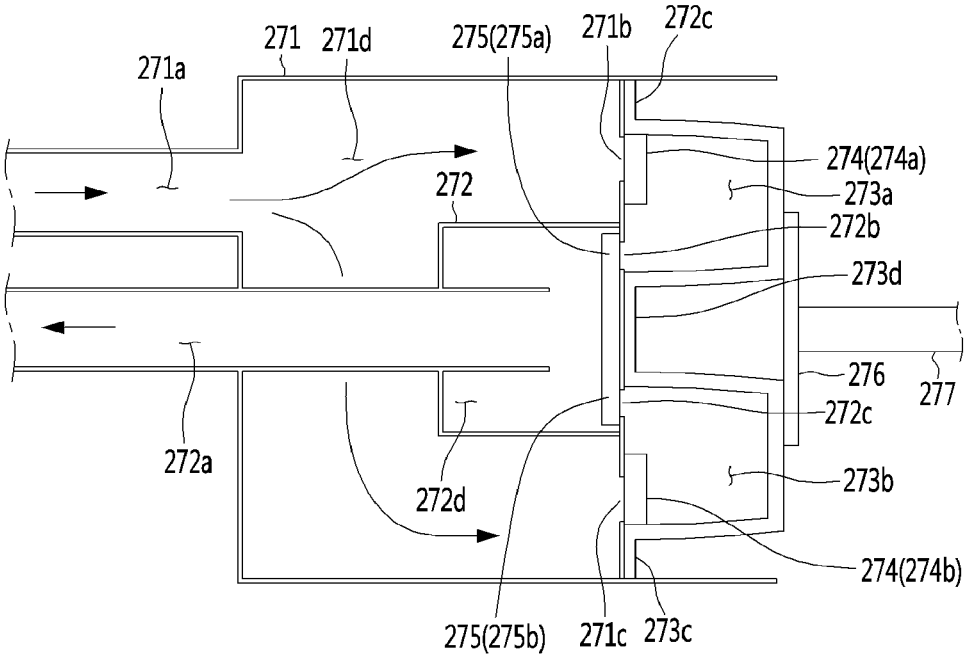
FIG. 34 is a view schematically showing a water pump in a standby state.
Figure 35:
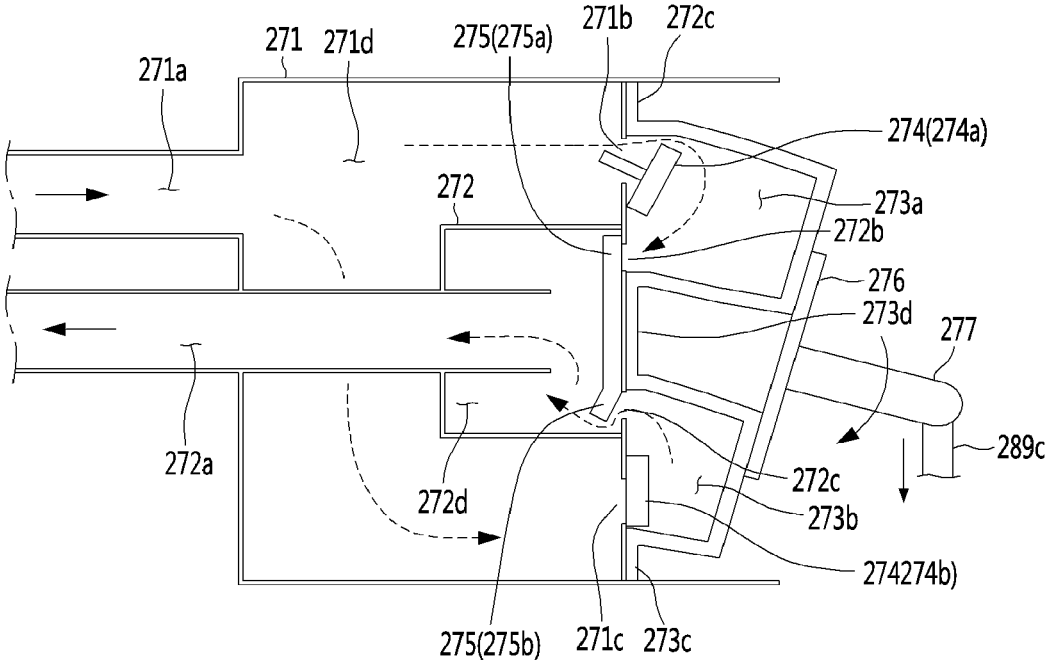
FIG. 35 is a view schematically showing a water pump in an operation state.
Figure 36:
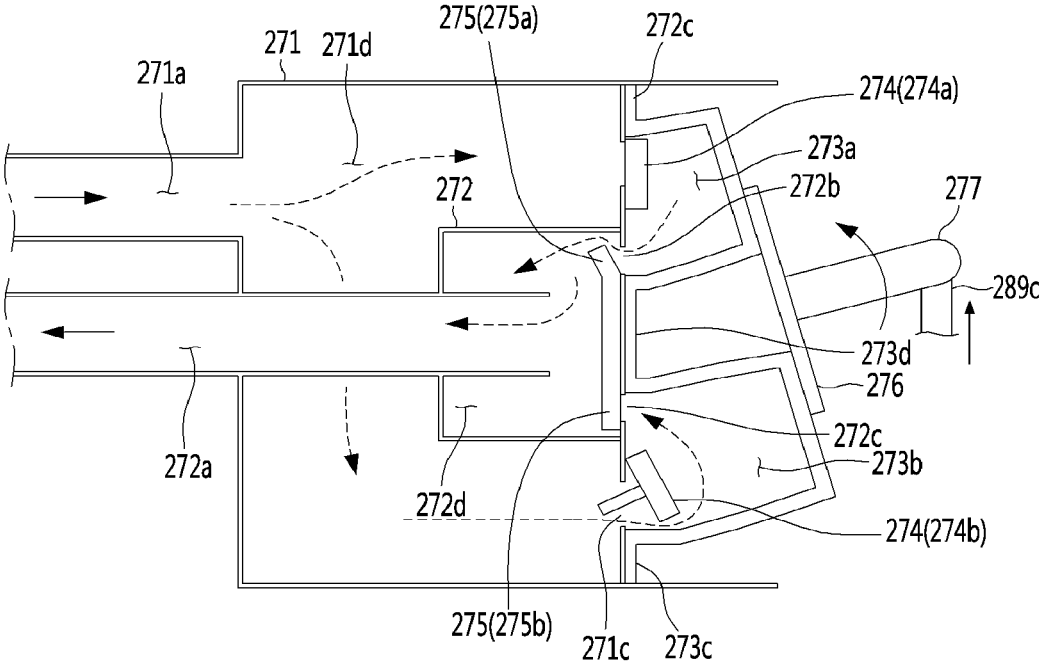
FIG. 36 is another view schematically showing a water pump in an operation state.

FIG. 33 is a view schematically showing the configuration of a water supply channel and a water pump that is a component of the present invention. FIG. 34 is a view schematically showing a water pump in a standby state. FIGS. 35 and 36 are views schematically showing a water pump in an operation state.

Referring to FIGS. 33 to 36, the water pump 230 performs pumping using torque from the driving motors 182 and 184 or may be connected with a pump motor 280 provided separately from the driving motors 182 and 184 and perform pumping using torque of the pump motor 280 itself.

Hereafter, the 'water pump' is described in more detail.

The water pump 270 may include an outer chamber 271, an inner chamber 272, a compressing member 273, valve members 274 and 275.

The outer chamber 271 has a first intake port 271*a* at a side connected with the first supply pipe 282 to receive water, first and second exhaust ports 271*b* and 271*c* formed at an upper portion and a lower portion of the other side to discharge water, and a space 271*d* therein.

The inner chamber 272 is formed in the outer chamber 271, has a third exhaust port 272*a* at a side connected with the second supply pipe 284 to discharge water, has third and fourth intake ports 272*b* and 272*c* formed at an upper portion and a lower portion to receive water, and has a space 272*d* therein.

The other surface of the inner chamber 272 may be integrally formed with the other surface of the outer chamber 271. The inner chamber 272 may extend into the space 271*d* defined in the outer chamber 271 from the other surface of the outer chamber 271.

The third and fourth intake ports 272*b* and 272*c* may be formed on the same plane as the first and second exhaust ports 271*b* and 271*c*.

The third and fourth intake ports 272*b* and 272*c* may be positioned between the first and second exhaust ports 271*b* and 271*c*.

The compression member 273 may be disposed outside the outer chamber 271 and may be fixed to the other side of the outer chamber 271. Further, the compression member 273 supplies water discharged through the first exhaust port 271*b* to the third intake port 272*b* and supplies water discharged through the second exhaust port 271*c* to the fourth intake port 272*c*.

The compression member 273 may be made of an elastic material such as rubber and silicon.

Further, the compression member 273 may include a first compression chamber 273*a* covering the first exhaust port 271*b* and the third intake port 272*b*, and a second compression chamber 273*b* covering the second exhaust port 271*c* and the fourth intake port 272*c* at the other side of the outer chamber 271.

The compression member 273 may have connecting portions 273*c* and 273*d* that are in contact with the other surface of the outer chamber 271.

The contact portion 273*c* may be extended in parallel with the other surface of the outer chamber 271 along the edge of the compression chamber 273 and fixed in surface contact with the other surface of the outer chamber 271.

Further, the contact portion 273*c* may be formed in parallel with the other surface of the outer chamber 271 and fixed in surface contact with the other surface of the outer chamber 271 between the first compression chamber 273*a* and the second compression chamber 273*b*.

The valve members 274 and 275 include first and second valve members 274*a* and 274*b* opening/closing the first and second exhaust ports 271*b* and 271*c* at the other sides of the first and second exhaust ports 271*b* and 271*c*, and a third and fourth valve members 275*a* and 275*b* opening/closing the third and fourth intake ports 272*b* and 272*c* at sides of the third and fourth intake ports 272*b* and 272*c*. The third and fourth valve members 275 and 275*b* may be integrally formed.

The valve member 274, 275 may be made of an elastic material such as rubber and silicon.

The water discharged to the first exhaust port 271*b* and the second exhaust port 271*c* of the outer chamber 271 flows from a first side to a second other side. The first and second valve members 274*a* and 274*b* may be fixed outside the other surface of the outer chamber 271 to allow water to flow from the first side to the second side (from the left to the right in FIG. 34) and to prevent water from flowing from the second side to the first side (from the right to the other side in FIG. 34).

Further, the water flowing into the third and fourth intake ports 272*b* and 272*c* of the inner chamber 272 flows from the second side to the first side. The third and fourth valve members 275 may be fixed inside the other surface of the outer chamber 271 to allow water to flow from the second side to the first side (from the right to the left in FIG. 34) and to prevent water from flowing from the first side to the second side (from the left to the right in FIG. 34).

The water pump 270 configured as described above can suction water in the water tank 200 or discharge the suctioned water to the mops 402 and 404, depending on the type of the compression member 273.

For example, when the first compression chamber 273*a* expands, the internal pressure of the first combustion chamber 273*a* instantaneously drops, so the first valve member 274*a* opens and the water in the outer chamber 271 flows into the first compression chamber 273*a*. Further, the water in the water tank 20 flows into the outer chamber 271 through the first supply pipe 241.

In this process, since the internal pressure of the first compression chamber 273*a* is low, the third intake port 272*b* is kept closed by the third valve member 275*a*.

Thereafter, when the first compression chamber 273*a* contracts, the internal pressure of the first compression chamber 273*a* instantaneously increases, so the third valve member 275*a* opens and the water that has flowed in the first compression chamber 273*a* is sent out to the inner chamber 272. Thereafter, the water flowing in the inner chamber 272 is supplied to the mops 402 and 404 through the third exhaust port 272*a*, the second supply pipe 284, and the auxiliary supply pipes 243 and 244.

In this process, since the internal pressure of the first compression chamber 273*a* is high, the first exhaust port 271*b* is kept closed by the first valve member 274*a*.

As another example, when the second compression chamber 273*b* expands, the internal pressure of the second combustion chamber 273*b* instantaneously drops, so the second valve member 274*b* opens and the water in the outer chamber 271 flows into the second compression chamber 273*b*. Further, the water in the water tank 20 flows into the outer chamber 271 through the first supply pipe 241.

In this process, since the internal pressure of the second compression chamber 273*b* is low, the fourth intake port 272*c* is kept closed by the fourth valve member 275*b*.

Thereafter, when the second compression chamber 273*b* contracts, the internal pressure of the second compression chamber 273*b* instantaneously increases, so the fourth valve member 275*b* opens and the water that has flowed in the second compression chamber 273*b* is sent out to the inner chamber 272. Thereafter, the water flowing in the inner chamber 272 is supplied to the mops 402 and 404 through the third exhaust port 272*a*, the second supply pipe 284, and the auxiliary supply pipes 243 and 244.

In this process, since the internal pressure of the second compression chamber 273*b* is high, the second exhaust port 271*c* is kept closed by the second valve member 274*b*.

The first combustion chamber 273*a* and the second combustion chamber 273*b* can be repeatedly expanded and contracted by a driving unit.

The driving unit may include a vertical plate 276 having a flat plate shape and fixed to the other ends of the first combustion chamber 273*a* and the second combustion chamber 273*b*, and a shaft 277 horizontally extending from the center of the vertical plate 276.

Further, the driving unit may include the pump motor 280 and a power transmission member 289 that converts and transmits rotation motion of the pump motor 280 into reciprocation motion.

The power transmission member 289 may include a rotary member 289*a* connected to the pump motor 280 to rotate such as a gear and a cam, a first link member 289*b* eccentrically rotatably coupled to the rotary member 289*a*, and a second link member 289*c* having an end rotatably fixed to the first link member 289*b* and the other end rotatably fixed to the shaft 277.

Referring back to FIG. 33, the rotary member 289*a* is coupled to the rotary shaft of the pump motor 280 to rotate. An end of the first link member 289*b* eccentrically rotatably connected to the rotary member 289*a* rotates while drawing a circle together with the first rotary member 289*a*.

Further, the second link member 289*c* connected to the other end of the first link member 280*b* is reciprocated by the first link member 289*b*.

In this process, the shaft 277 connected to an end of the second link member 289*c* is vertically moved, and the vertical plate 276 and the compression member 273 that are connected to the shaft 277 are moved upward, thereby operating as a pump.

As another example, the power transmission member 289 may include only the rotary member 289*a* connected to the pump motor 280 to rotate such as a gear and a cam. The first link member 289*b*, having an end eccentrically rotatably coupled to the rotary member 289*a*, and in this case, the other end of the first link member 289*b*, is rotatably fixed to the shaft 277.

In the following description, it is exemplified that the second link member 289*c*, the pump motor 280, etc. are disposed under the shaft 277 to move up and down, but the scope of the present invention is not limited thereto, and the second link member 289*c*, the pump motor 280, etc. may be disposed over the shaft 277 to move up and down. Further, the second link member 289*c*, the pump motor 280, etc. may be disposed in parallel with the shaft 277 to horizontally reciprocate.

Referring to FIG. 33, when the first link member 289*b* is rotated from the lower end to the upper end, an end of the second link member 289*c* pushes up the shaft 277, and the vertical plate 276 and the compression member 273 connected with the shaft 277 are rotated to a side (counterclockwise in FIG. 33). In this process, the first compression chamber 273*a* contracts and the second compression chamber 273*b* expands.

As described above, when the first compression chamber 273*a* contracts and the second compression chamber 273*b* expands, as shown in FIG. 36, the internal pressure of the second compression chamber 273*b* instantaneously drops and the second valve member 274*b* opens, so the water in the outer chamber 271 flows into the second compression chamber 273*b* through the second exhaust port 271*c*. By this process, the water in the water tank 200 flows into the second combustion chamber 273*b*.

In this process, since the internal pressure of the second compression chamber 273*b* has dropped with expansion, the fourth intake port 272*c* keeps closed by the fourth valve member 275*b*.

Meanwhile, the first compression chamber 273*a* contracts and the internal pressure of the first compression chamber 273*a* instantaneously increases, as shown in FIG. 36, so the third valve member 275*a* opens and the water in the first compression chamber 273*a* is sent out to the inner chamber 272 through the third intake port 272*b*. Thereafter, the water flowing in the inner chamber 272 is supplied to the mops 402 and 404 through the third exhaust port 272*a*.

In this process, since the internal pressure of the first compression chamber 271 is high, the first exhaust port 271*b* keeps closed by the first valve member 274*a*.

In contrast, when the first link member 289*b* is rotated from the upper end to the lower end, an end of the second link member 289*c* pulls down the shaft 277, and the vertical plate 276 and the compression member 273 connected with the shaft 277 are rotated to the other side (clockwise in FIG. 33). In this process, the first compression chamber 273*a* expands and the second compression chamber 273*b* contracts.

As described above, when the first compression chamber 273*a* expands and the second compression chamber 273*b* contracts, as shown in FIG. 35, the internal pressure of the first compression chamber 273*a* instantaneously drops and the first valve member 274*a* opens, so the water in the outer chamber 271 flows into the first compression chamber 273*a* through the first exhaust port 271*b*. By this process, the water in the water tank 200 flows into the first combustion chamber 273*a*.

In this process, since the internal pressure of the first compression chamber 273*a* has dropped, the third intake port 272*b* keeps closed by the third valve member 275*a*.

Meanwhile, when the second compression chamber 273*b* contracts, as shown in FIG. 35, the internal pressure of the second compression chamber 273*b* instantaneously increases, so the fourth valve member 275*b* opens and the water in the second compression chamber 273*b* is sent out to the inner chamber 272 through the fourth intake port 272*c*. Thereafter, the water flowing in the inner chamber 272 is supplied to the mops 402 and 404 through the third exhaust port 272*a*.

In this process, since the internal pressure of the second compression chamber 273*b* is high, the second exhaust port 271*c* keeps closed by the second valve member 274*b*.

As described above, the process of FIG. 35 in which the pump motor 280 is rotated, the second link member 289*c* and the shaft 277 connected with the second link member 289*c* are moved up and down, the first compression chamber 273*a* expands, and the second compression chamber 273*b* contracts and the process of FIG. 36 in which the first compression chamber 273*a* contracts and the second compression chamber 273*b* expands is repeated, whereby the water in the water tank 200 can be periodically supplied to the mops 402 and 404 through the water pump 270.

Further, a cleaner main body (not shown) connected with the nozzle for a cleaner according to the present invention may further include an adjusting unit (not shown) that adjusts whether to operate the driving motors 182 and 184 and the pump motor 280 and the revolution per minute (RPM) of the driving motors 182 and 184 and the pump motor 280.

For example, the adjusting unit (not shown) may be formed at a handle portion of the cleaner main body (not shown). The adjusting unit (not shown) may include a power button (on/off button) for the driving motors 182 and 184 or the pump motor 280 or an RPM adjustment button (intensity button) of the driving motors 182 and 184 or the pump motor 280.

In particular, adjusting unit (not shown) may be formed adjacent to buttons for adjusting the general operation of the cleaner.

When the adjustment is provided, it is possible to adjust the RPM of the mops 402 and 404 connected with the driving motors 182 and 184 by adjusting the RPM of the driving motors 182 and 184.

Further, it is possible to adjust the RPM of the pump motor 280. Further, it is possible to adjust the reciprocation speed (up/down-movement period) of the shaft 277.

For example, when the RPM of the pump motor 280 is increases, the reciprocation speed of the shaft 277 and the pumping speed of the compression member 273 may increase. Further, the amount of water to be discharged per unit time from the water tank 200 may increase.

Further, when the RPM of the pump motor 280 decreases, the reciprocation speed of the shaft 277 and the pumping speed of the compression member 273 may decrease. Further, the amount of water to be discharged per unit time from the water tank 200 may decrease.

Further, the top of the water tank 200 is inclined upward from the front to the rear. That is, the height is larger at the front than the rear, and the front is slim.

As described above, when the top of the water tank 200 is inclined upward from the front to the rear, the slim front end of the nozzle for a cleaner can go into low spaces such as under a furniture, a sofa, and a bed when a floor is cleaned by the nozzle for a cleaner. Therefore, it is possible to clean spaces with small heights.

In order to further decrease the height of the front end of the nozzle for a cleaner, the parts such as the driving motors 182 and 184 described above may be disposed not ahead of but behind the nozzle assembly 100.

According to the present invention described above, it is possible to simultaneously clean a floor by suctioning air and wiping the floor with wet dust cloths, so the floor can be more cleanly cleaned.

Further, it is possible to periodically supply water during cleaning in order to prevent the dust cloths from getting dry during cleaning with wet dust cloths. Therefore, it is possible to increase cleaning efficiency and convenience for a user.

Further, it is possible to periodically supply the water stored in the water tank to the dust cloths using torque from the motors that rotate the dust cloths.

Further, it is possible to easily change the amount of water to be supplied to the dust cloths per unit time.

Since the front end of the nozzle assembly having the suction nozzle is slim, spaces with small heights can be easily cleaned.

What is claimed is:

1. A nozzle for a cleaner, comprising:

a nozzle housing including an intake channel configured to suction air;

a first rotary cleaning unit and a second rotary cleaning unit spaced apart from each other in a lateral direction and arranged under the nozzle housing, wherein each of the first and second rotary cleaning units includes a rotary plate configured to be coupled to a dust cloth;

a water tank provided on the nozzle housing and configured to store water;

a water supply channel disposed in the nozzle housing and configured to supply water in the water tank to each of the first and second rotary cleaning units; and a water pump disposed in the water supply channel, wherein the water supply channel includes:

a supply pipe configured to allow water discharged from an exhaust port of the water tank to flow therethrough;

a connector coupled to the supply pipe;

a first diverging pipe coupled to the connector and configured to supply water to the first rotary cleaning unit; and a second diverging pipe coupled to the connector and configured to supply water to the second rotary cleaning unit, wherein the intake channel extends in a front-rear direction of the nozzle housing to divide the nozzle housing into a left area and a right area, and wherein the exhaust port and the water pump are positioned on one side area of the intake channel.

2. The nozzle for a cleaner of claim 1, wherein the supply pipe includes:

a first supply pipe coupled to an inlet of the water pump; and a second supply pipe coupled to an outlet of the water pump and the connector.

3. The nozzle for a cleaner of claim 2, wherein the nozzle housing further includes a valve unit that operates to introduce water from the exhaust port of the water tank, and wherein the first supply pipe is connected to the valve unit.

4. The nozzle for a cleaner of claim 3, wherein the valve unit is disposed to face the exhaust port of the water tank in a vertical direction.

5. The nozzle for a cleaner of claim 3, wherein the exhaust port of the water tank and the valve unit are disposed relatively close to a front end of the nozzle.

6. The nozzle for a cleaner of claim 3, wherein the water pump is disposed between the valve unit and the connector.

7. The nozzle for a cleaner of claim 3, wherein the nozzle housing is provided with a control board for controlling a rotation of the rotary plate, and wherein the control board is disposed at a position opposite to the valve unit with respect to the intake channel.

8. The nozzle for a cleaner of claim 3, wherein a water passage opening through which the water discharged from the water tank passes is formed in an upper portion of the nozzle housing, and wherein the valve unit includes a pressing portion passing through the water passage opening.

9. The nozzle for a cleaner of claim 8, wherein the pressing portion protrudes upward from the upper portion of the nozzle housing in a state of passing through the water passage opening.

10. The nozzle for a cleaner of claim 8, wherein a connection portion for connecting the first supply pipe is provided at one side of the valve unit.

11. The nozzle for a cleaner of claim 8, wherein a diameter of the water passage opening is larger than an outer diameter of the pressing portion.

12. The nozzle for a cleaner of claim 8, wherein, when the water tank is seated on the nozzle housing, the pressing portion is configured to insert into the exhaust port of the water tank.

13. The nozzle for a cleaner of claim 3, wherein the nozzle housing includes a nozzle base and a nozzle cover coupled to an upper side of the nozzle base, and wherein the valve unit is coupled to a lower side of the nozzle cover.

14. The nozzle for a cleaner of claim 13, wherein a portion of the valve unit protrudes upward through the nozzle cover.

15. The nozzle for a cleaner of claim 14, wherein the water tank is detachably coupled to an upper portion of the nozzle cover.

16. The nozzle for a cleaner of claim 13, wherein the connector is positioned below the nozzle cover.

17. The nozzle for a cleaner of claim 16, wherein the connector is disposed to overlap with the intake channel in a vertical direction.

18. The nozzle for a cleaner of claim 1, wherein the connector is positioned at a center portion of the nozzle housing.

19. The nozzle for a cleaner of claim 18, wherein the first diverging pipe and the second diverging pipe are formed to have the same length.

20. The nozzle for a cleaner of claim 18, wherein an end portion of the first diverging pipe and an end portion of the second diverging pipe are arranged to face the rotary cleaning units in a vertical direction, respectively.

21. The nozzle for a cleaner of claim 1, wherein the nozzle housing further includes a spray nozzle for spraying water to each of the rotary cleaning units, and the spray nozzle includes a connecting portion for connection with the first or the second diverging pipe.

22. The nozzle for a cleaner of claim 1, wherein the intake channel includes:

a first channel extending in the lateral direction from a front end of the nozzle housing; and a second channel extending in a front-rear direction from a center of the first channel.

23. The nozzle for a cleaner of claim 22, wherein the connector is disposed to overlap the second channel in a vertical direction.

24. The nozzle for a cleaner of claim 23, wherein the connector has a shape equivalent to that of the intake channel.

25. The nozzle for a cleaner of claim 24, wherein the connector is formed such that a first connection unit, a second connection unit and a third connection unit are arranged in a T-shape, wherein the supply pipe is connected to the first connection unit, wherein the first diverging pipe is connected to the second connection unit, and wherein the second diverging pipe is connected to the third connection unit.

26. The nozzle for a cleaner of claim 3, wherein the water tank includes:

a tank body including a chamber configured to store water, the tank body including the exhaust port; and a valve configured to open and close the exhaust port in the tank body, wherein the valve unit is configured to control the valve of the water tank so as to open the exhaust port when the water tank is seated on the nozzle housing.

27. The nozzle for a cleaner of claim 1, wherein the first diverging pipe and the second diverging pipe are symmetrically disposed with respect to the connector.

28. The nozzle for a cleaner of claim 1, wherein the water tank includes a chamber positioned above the nozzle housing to cover a shape of a driving motor for rotating the rotary plate.

29. The nozzle for a cleaner of claim 1, wherein the rotary plate includes a plurality of water passage holes configured to pass water discharged from the water supply channel.

30. The nozzle for a cleaner of claim 1, wherein the exhaust port and the water pump are positioned in a same side area with respect to the intake channel extending in the front and rear direction of the nozzle housing.

* * * * *